US008249493B2

(12) United States Patent
Matsubara et al.

(10) Patent No.: US 8,249,493 B2
(45) Date of Patent: Aug. 21, 2012

(54) FIXING APPARATUS AND IMAGE FORMING APPARATUS

(75) Inventors: Takashi Matsubara, Kanagawa (JP); Makoto Furuki, Kanagawa (JP); Naoyuki Egusa, Kanagawa (JP); Tetsuro Kodera, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 228 days.

(21) Appl. No.: 12/860,385

(22) Filed: Aug. 20, 2010

(65) Prior Publication Data

US 2011/0222936 A1 Sep. 15, 2011

(30) Foreign Application Priority Data

Mar. 11, 2010 (JP) ..... 2010-054582

(51) Int. Cl.
*G03G 15/20* (2006.01)

(52) U.S. Cl. ..... 399/336; 399/337; 399/45

(58) Field of Classification Search ..... 399/336, 399/337, 45, 67, 122
See application file for complete search history.

(56) References Cited

U.S. PATENT DOCUMENTS

| | | | | |
|---|---|---|---|---|
| 5,436,710 | A | 7/1995 | Uchiyama | |
| 5,459,561 | A * | 10/1995 | Ingram | 399/336 |
| 6,587,665 | B2 * | 7/2003 | Bartscher et al. | 399/336 |
| 6,927,405 | B1 * | 8/2005 | Bonnet et al. | 250/493.1 |

FOREIGN PATENT DOCUMENTS

| | | |
|---|---|---|
| JP | A-53-6044 | 1/1978 |
| JP | A-54-137342 | 10/1979 |
| JP | A-55-050252 | 4/1980 |
| JP | A-3-116175 | 5/1991 |

* cited by examiner

*Primary Examiner* — Walter L Lindsay, Jr.
*Assistant Examiner* — Roy Y Yi
(74) *Attorney, Agent, or Firm* — Oliff & Berridge, PLC

(57) ABSTRACT

A fixing apparatus includes a light irradiation unit and a reflector. The light irradiation unit irradiates a recording medium conveyed in a conveying direction with laser light along a first direction that is substantially perpendicular to the conveying direction. The reflector reflects first to fourth angular components of a part of the laser light reflected at an irradiation position at which the recording medium is irradiated, such that a first intersection point between the first and third angular components after the reflection and a second intersection point between the second and fourth angular components after the reflection as seen in a second direction that is substantially perpendicular to the conveying direction and the first direction are at different positions in a direction of displacement of the recording medium, the direction of displacement crossing the conveying direction. A developing agent on the recording medium is melted by the laser light.

4 Claims, 22 Drawing Sheets

FIXING APPARATUS AND IMAGE FORMING APPARATUS

CROSS-REFERENCE TO RELATED APPLICATIONS

This application is based on and claims priority under 35 USC 119 from Japanese Patent Application No. 2010-054582 filed Mar. 11, 2010.

BACKGROUND

The present invention relates to a fixing apparatus and an image forming apparatus.

SUMMARY

According to an aspect of the invention, there is provided a fixing apparatus including a light irradiation unit that emits laser light to irradiate a recording medium conveyed in a conveying direction, the laser light being emitted along a first direction that is substantially perpendicular to the conveying direction; and a reflector that reflects a first angular component, a second angular component, a third angular component, and a fourth angular component of a part of the laser light emitted by the light irradiation unit, the part of the laser light being reflected at an irradiation position at which the recording medium is irradiated with the laser light by the light irradiation unit, the second angular component being different from the first angular component, the third angular component being different from or the same as the first angular component, the fourth angular component being different from the first, second, and third angular components, the reflector reflecting the first, second, third, and fourth angular components such that a first intersection point between the first and third angular components after the reflection as seen in a second direction that is substantially perpendicular to the conveying direction and the first direction and a second intersection point between the second and fourth angular components after the reflection as seen in the second direction are at different positions in a direction of displacement of the recording medium, the direction of displacement crossing the conveying direction. A developing agent on the recording medium is melted by energy of the laser light.

BRIEF DESCRIPTION OF THE DRAWINGS

Exemplary embodiments of the present invention will be described in detail based on the following figures, wherein.

DETAILED DESCRIPTION

A fixing apparatus and an image forming apparatus according to a first exemplary embodiment of the present invention will now be described.

Figure 1:
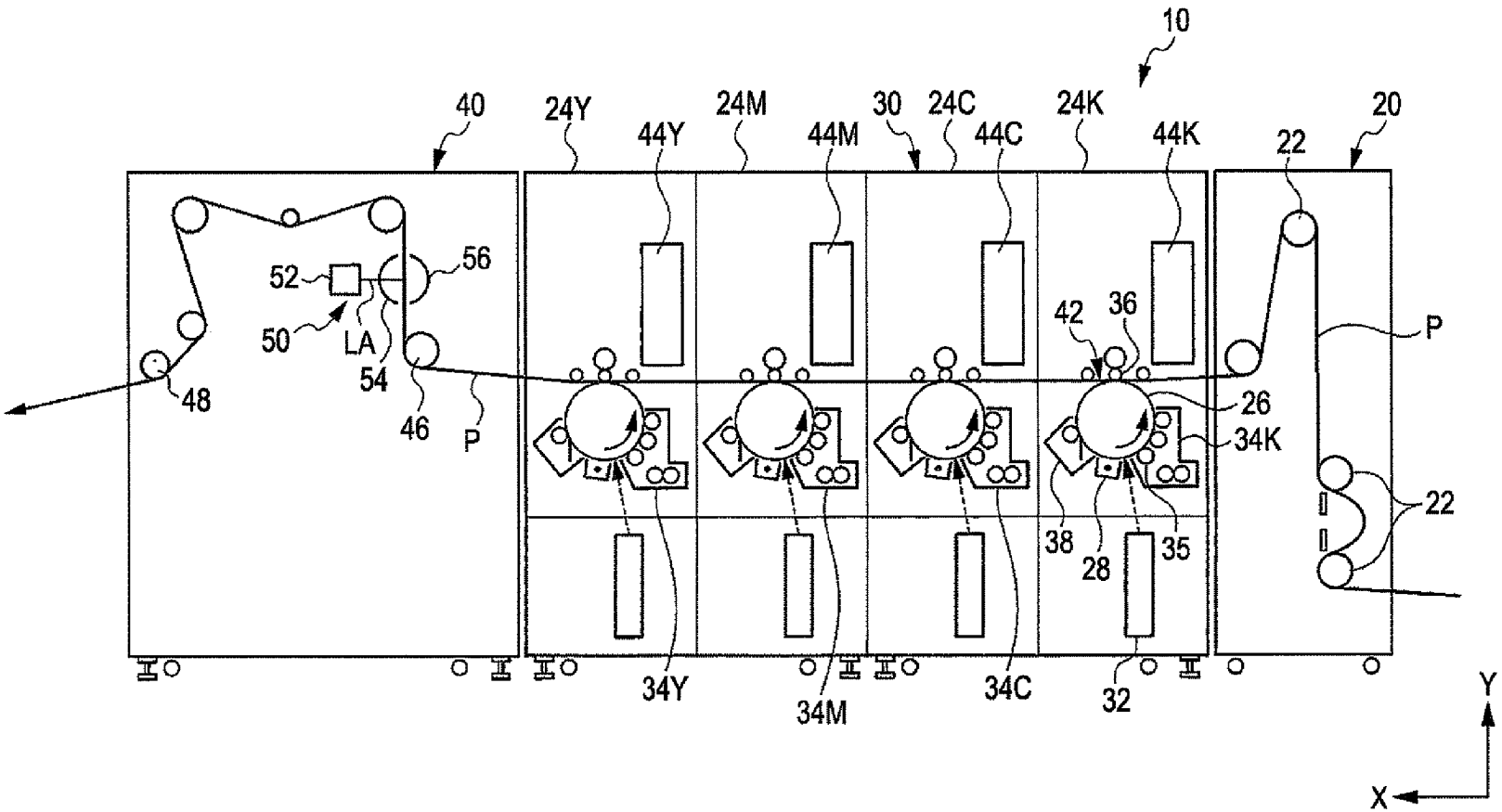
FIG. 1 is a diagram illustrating the overall structure of an image forming apparatus according to a first exemplary embodiment of the present invention.

FIG. 1 illustrates an image forming apparatus 10 according to the first exemplary embodiment. The image forming apparatus 10 forms an image on continuous paper P, which is a recording medium, and includes a paper conveying section 20, an image forming section 30, and a fixing section 40 arranged in order from the right side (upstream side) to the left side (downstream side) along the X direction in FIG. 1. The paper conveying section 20 conveys the continuous paper P. The image forming section 30 is an example of an image forming member that forms an image and transfers the image onto the continuous paper P. The fixing section 40 includes a fixing apparatus 50 that fixes the image transferred onto the continuous paper P.

The paper conveying section 20 includes conveying rollers 22 around which the continuous paper P is wound and which convey the continuous paper P. The paper conveying section 20 conveys the continuous paper P toward the image forming section 30 while applying a tension to the continuous paper P.

The image forming section 30 includes four image forming units 24K, 240, 24M, and 24Y in order from the upstream side to the downstream side along a conveying direction of the continuous paper P. The image forming units 24K, 24C, 24M, and 24Y respectively form toner images, which are visual images, using black (K), cyan (C), magenta (M), and yellow (Y) toners, which are an example of developing agent. The toner of each color is made of a material that absorb laser light L emitted from the fixing apparatus 50, which will be described below. In the following descriptions, the letters 'K', 'C', 'M', and 'Y' are attached to reference numerals denoting components corresponding to black, cyan, magenta, and yellow when they are to be distinguished from each other. The letters 'K', 'C', 'M', and 'Y' are omitted when it is not necessary to distinguish the components corresponding to the respective colors.

Each image forming unit 24 includes a photosensitive member 26 including a cylindrical component made of a conductive material and a photoconductive layer formed on a peripheral surface of the cylindrical component. A charging device 28, an exposure device 32, a developing device 34, a transfer roller 36, and a cleaning device 38 are disposed around the photosensitive member 26 in that order from an upstream position to a downstream position in a rotation direction of the photosensitive member 26 (counterclockwise in FIG. 1). The charging device 28 charges a surface of the photosensitive member 26. The exposure device 32 forms a latent image on the surface of the photosensitive member 26 by irradiating the charged photosensitive member 26 with light. The developing device 34 includes a developing roller 35 that forms (develops) a toner image by transferring toner to the latent image on the photosensitive member 26. The transfer roller 36 is disposed so as to face the photosensitive member 26 to form a transfer section 42, and transfers the toner image formed on the photosensitive member 26 onto the continuous paper P. The cleaning device 38 removes the toner that remains on the surface of the photosensitive member 26 after the toner image is transferred onto the continuous paper P.

Toner supply containers 44K, 44C, 44M, and 44Y are disposed above the developing devices 34K, 34C, 34M, and 34Y, respectively, to supply the toners of the same colors as those of the toners contained in the respective developing devices 34, thereby refilling the respective developing devices 34 as the toners are consumed in the developing process.

The fixing section 40 includes the fixing apparatus 50, a conveying roller 46, and an ejecting roller 48. The fixing apparatus 50 fixes unfixed toner images, which have been transferred onto the continuous paper P in the image forming section 30, on the continuous paper P. The conveying roller 46 conveys the continuous paper P that is wound around the conveying roller 46 to the fixing apparatus 50. The ejecting roller 48 ejects the continuous paper P on which the toner images are fixed to the outside of the image forming apparatus 10.

An image forming method carried out by the image forming apparatus 10 will now be described.

Referring to FIG. 1, when an image forming operation is started in the image forming apparatus 10, the peripheral surface of each photosensitive member 26 is charged to, for example, negative polarity by the corresponding charging device 28 in the image forming section 30. Then, each exposure device 32 irradiates the charged peripheral surface of the corresponding photosensitive member 26 with light (exposure light) on the basis of image data, thereby forming a latent image, in which a potential difference is provided between the exposed and unexposed areas, on the peripheral surface of the photosensitive member 26.

In each developing device 34, a thin layer of developing agent (including toner) is formed on the peripheral surface of the developing roller 35. As the developing roller 35 rotates, the toner in the thin layer is conveyed to a developing position where the toner faces the peripheral surface of the photosensitive member 26. At the developing position, an electric field is formed between the photosensitive member 26 and the developing roller 35. In this electric field, the toner on the developing roller 35 is transferred to the latent image on the photosensitive member 26, and the toner image is formed accordingly. The thus-formed toner image is conveyed by the rotation of the photosensitive member 26 to the transfer section 42 in which the transfer roller 36 is in contact with the continuous paper P.

The continuous paper P is conveyed from the paper conveying section 20 to the transfer section 42. An electric field is formed in the transfer section 42 by a transfer bias voltage applied to the transfer roller 36, and the toner image is transferred onto the continuous paper P in the electric field. The continuous paper P is successively conveyed to the transfer section 42 in each image forming unit 24, so that toner images of respective colors are transferred in a superimposed manner.

The continuous paper P onto which the toner images have been transferred is wound around the conveying roller 46 and is conveyed to the fixing apparatus 50 while the toner images are retained thereon. In the fixing apparatus 50, the continuous paper P is irradiated with laser light LA (which will be described in detail below), so that the toner on the continuous paper P is heated and melted, and is thereby fixed as described in detail below. After the toner images are fixed on the continuous paper P, the continuous paper P is ejected to the outside of the image forming apparatus 10 by the ejecting roller 48. In this way, an image is formed on the continuous paper P.

The structure of the fixing apparatus 50 will now be described.

Figure 2:
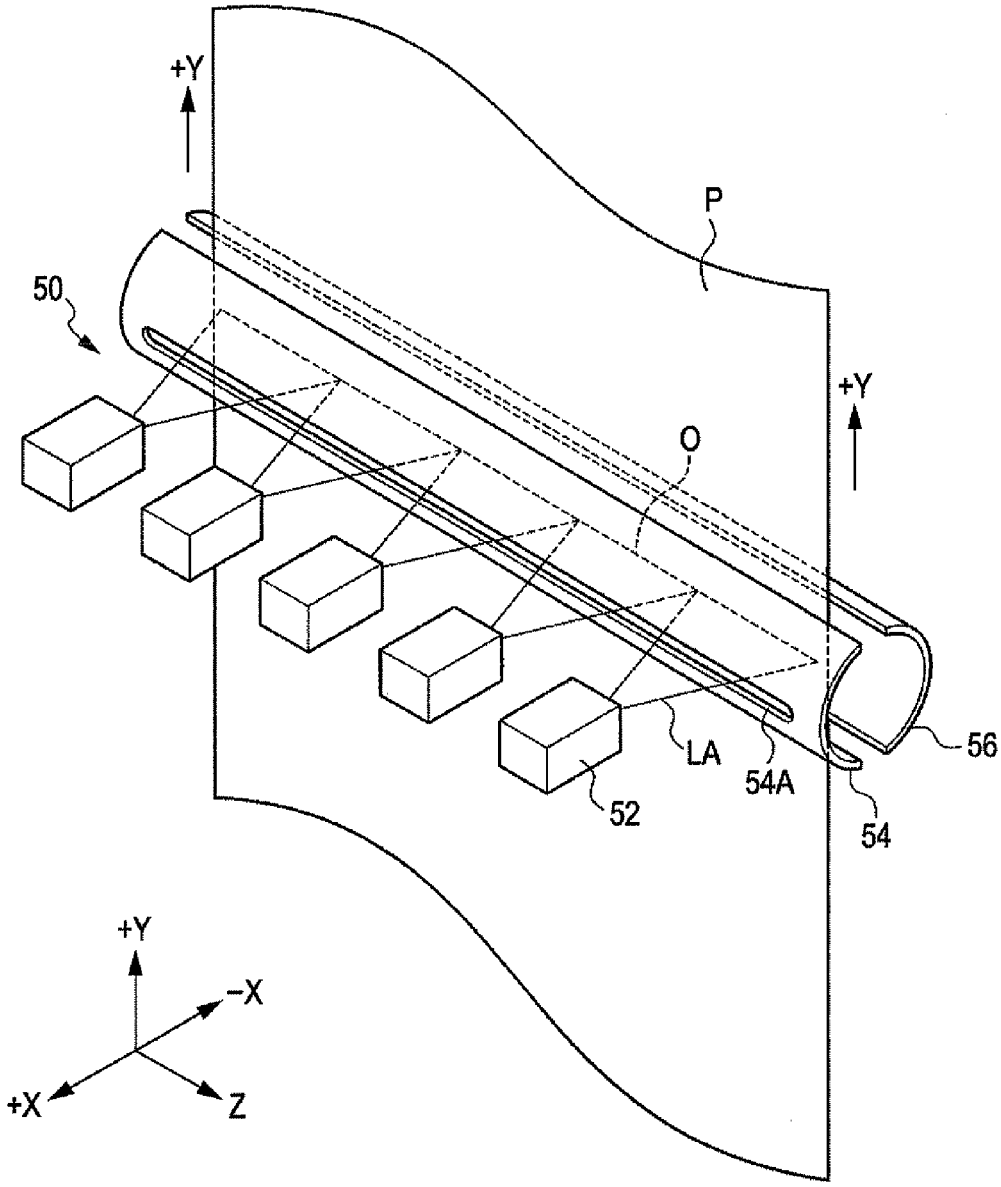
FIG. 2 is a schematic perspective view of a fixing apparatus according to the first exemplary embodiment of the present invention.
Figure 3:
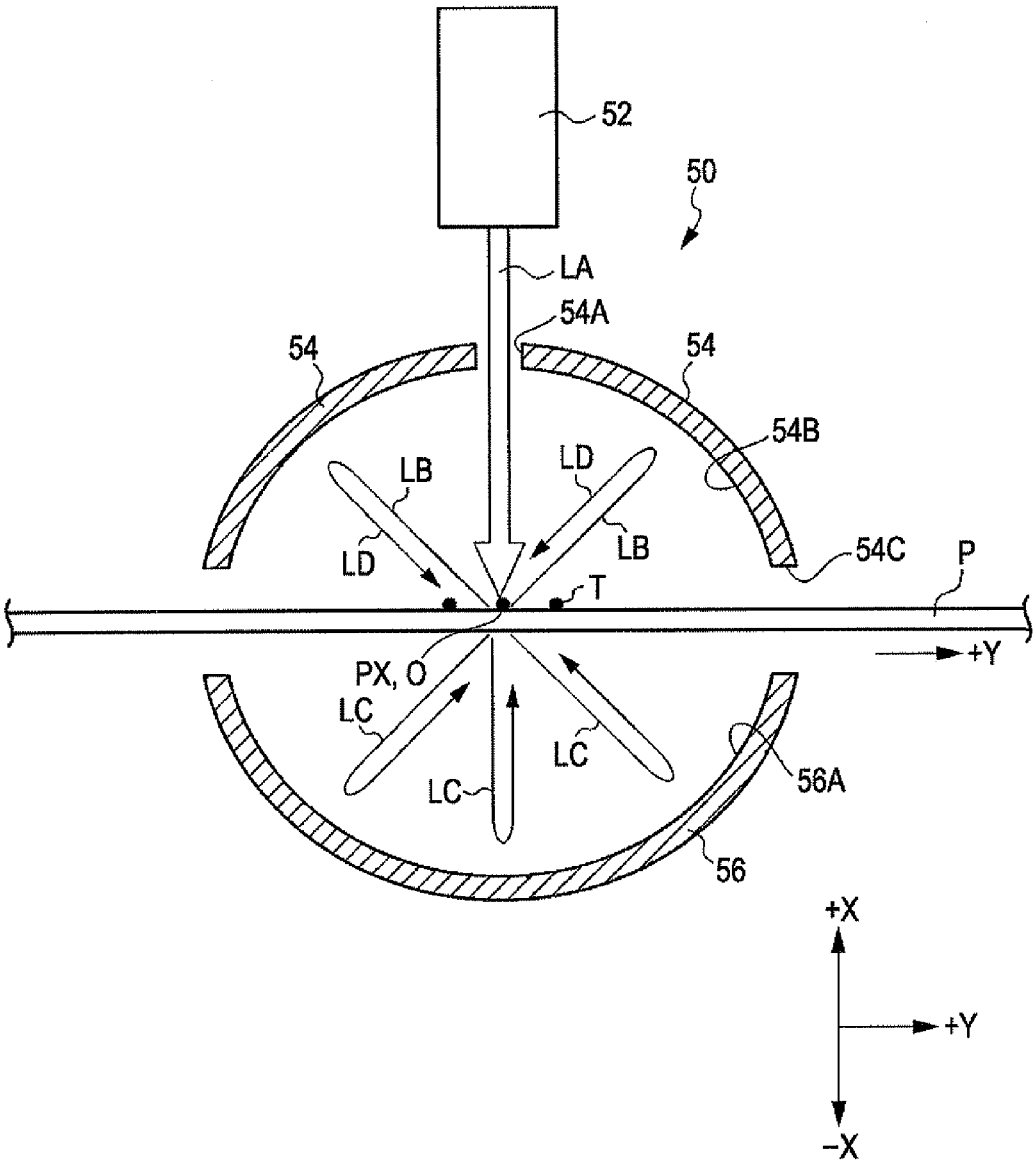
FIG. 3 is a sectional view of the fixing apparatus according to the first exemplary embodiment of the present invention.

Referring to FIGS. 2 and 3, the fixing apparatus 50 includes laser-light generators 52, a first reflector 54, and a second reflector 56. The laser-light generators 52 are an example of light irradiation units that are disposed so as to face the continuous paper P and that emit laser light LA in a first direction (−X direction) that is perpendicular to or substantially perpendicular to the conveying direction (+Y direction) of the continuous paper P. The first reflector 54 is an example of a reflector that reflects scattered light LB, which is generated when a part of the laser light LA is reflected by the continuous paper P, toward the continuous paper P. The second reflector 56 reflects transmitted light LC, which is scattered light generated when a part of the laser light LA passes through the continuous paper P, toward the continuous paper P.

The laser-light generators 52 are arranged in a single row along a second direction (Z direction, which is the width direction of the continuous paper P) that is perpendicular to or substantially perpendicular to both the conveying direction of the continuous paper P and the first direction, and irradiate the continuous paper P with the laser light LA over the entire width thereof. The laser-light generators 52 are arranged such that irradiation energy of the laser light LA emitted toward an image surface of the continuous paper P is substantially uniform over a predetermined range in the conveying direction of the continuous paper P. The irradiation energy of the laser light LA is adjusted in advance such that the toner that passes through an irradiation area in which the continuous paper P is irradiated with the laser light LA may be heated and melted to be fixed on the continuous paper P. In the present exemplary embodiment, semiconductor lasers are used as an example of the laser-light generators 52, and the beam width of the laser light LA in the Y direction is set to about 1 mm. Although the laser light also has a width in the Z direction, the manner in which the laser light travels in the X-Y plane will be explained in the following descriptions.

The first reflector 54 is formed of a metal mirror having a semi-elliptical shape in the X-Y plane, the semi-elliptical shape being centered on a central axis O in design (which corresponds to the position of the continuous paper P in design in the state in which the continuous paper P is stationary without being bent or displaced in the X direction) and having a long axis in the Y direction and a short axis in the X direction. The first reflector 54 is shaped such that the longitudinal direction thereof coincides with the Z direction, and is disposed such that a first reflective surface 54B, which is a concave surface, faces the image surface of the continuous paper P. A light entrance 54A is formed in the first reflective surface 54B at a central area thereof in the circumferential direction such that the longitudinal direction of the light entrance 54A coincides with the Z direction. Accordingly, the laser light LA emitted from the laser-light generators 52 toward the continuous paper P passes through the light entrance 54A and is incident on the image surface of the continuous paper P.

The first reflective surface 54B is disposed so as to cover a fixing position PX, which is a position at which the laser light LA is first incident on the continuous paper P and at which fixing of the toner is performed, in a side view (X-Y plane) of the fixing apparatus 50, and to cover the image area of the continuous paper P over the entire width thereof in the Z direction. Accordingly, the first reflector 54 reflects most of the scattered light LB, which is a part of the laser light LA that has been reflected by the continuous paper P, and collects the scattered light LB at the fixing position PX or a position near the fixing position PX. In the present exemplary embodiment, the ratio of the long axis of the first reflector 54 to the short axis thereof is set to, for example, 50:49.5, and the distance from end portions 54C of the first reflector 54 in the circumferential direction to the continuous paper P in the X-Y plane is set to, for example, 5 mm.

The second reflector 56 is formed of a metal mirror having a semi-elliptical shape in the X-Y plane, the semi-elliptical shape being centered on the central axis O in design and having a long axis in the Y direction and a short axis in the X direction. The second reflector 56 is disposed symmetrically to the first reflector 54 with respect to the central axis O. The second reflector 56 is shaped such that the longitudinal direction thereof coincides with the Z direction, and is disposed such that a second reflective surface 56A, which is a concave surface, faces a surface of the continuous paper P at the side opposite to the image surface.

The second reflective surface 56A is disposed so as to cover a position corresponding to the fixing position PX at the back side of the continuous paper P (position on the back surface of the continuous paper P) and to cover the continuous paper P over the entire width thereof in the Z direction, and is opposed to the first reflective surface 54B with the continuous paper P disposed therebetween. Accordingly, the second reflector 56 reflects most of the transmitted light LC, which is a part of the laser light LA that has passed through the continuous paper P, toward a position near the position corresponding to the fixing position PX at the back side of the continuous paper P.

A fixing apparatus 200 according to a comparative example and the operation thereof will now be described.

Figure 7:
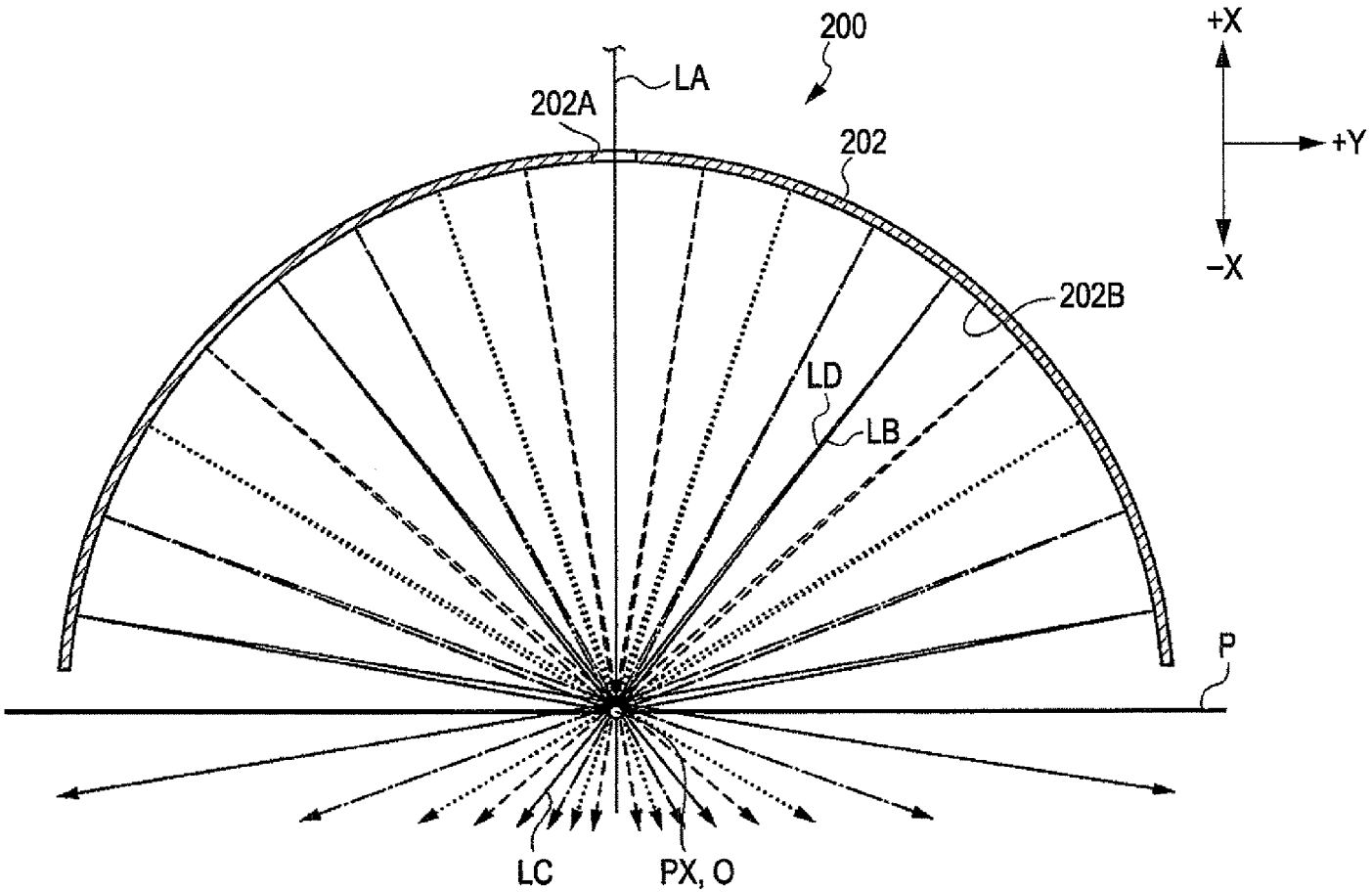
FIG. 7 is a schematic diagram illustrating the state in which laser light is reflected and collected by a reflector included in a fixing apparatus according to a comparative example.

FIG. 7 illustrates the state in which laser light is reflected and collected in the fixing apparatus 200 according to the comparative example. The fixing apparatus 200 includes the laser-light generators 52 (not shown) according to the present exemplary embodiment, a first reflector 202, and a second reflector (not shown). The first reflector 202 reflects scattered light LB, which is generated when a part of the laser light LA is reflected by the continuous paper P, toward the continuous paper P. The second reflector reflects transmitted light LC, which is scattered light generated when a part of the laser light LA passes through the continuous paper P toward the continuous paper P. Here, it is assumed that the first reflector 202 and the second reflector according to the comparative example have the same shape and dimension and the second reflector is disposed symmetrically to the first reflector 202 with respect to the central axis O in design. Therefore, explanations regarding the reflection of laser light by the second reflector will be omitted, and only the first reflector 202 will be described.

The first reflector 202 is formed of a metal mirror having a semi-circular shape in the X-Y plane, the semi-circular shape being centered on the central axis O in design. The first reflector 202 is shaped such that the longitudinal direction thereof coincides with the Z direction (direction perpendicular to FIG. 7), and is disposed such that a first reflective surface 202B, which is a concave surface, faces the image surface of the continuous paper P. A light entrance 202A is formed in the first reflective surface 202B at a central area thereof in the circumferential direction such that the longitudinal direction of the light entrance 202A coincides with the Z direction. Accordingly, the laser light LA emitted from the laser-light generators 52 toward the continuous paper P passes through the light entrance 202A and is incident on the image surface of the continuous paper P.

The first reflective surface 202B is disposed so as to cover a fixing position PX, which is a position at which the laser light LA is first incident on the continuous paper P in a side view of the fixing apparatus 200, and to cover the image area of the continuous paper P over the entire width thereof in the Z direction. Accordingly, the first reflector 202 reflects most of the scattered light LB, which is a part of the laser light LA that has been reflected by the continuous paper P, and collects the scattered light LB at the fixing position PX or a position near the fixing position PX.

In the fixing apparatus 200 according to the comparative example, when the laser light LA is emitted from the laser-light generators 52 toward the continuous paper P, a part of the laser light LA is reflected at the fixing position PX as the scattered light LB, and another part of the laser light LA passes through the continuous paper P as the transmitted light LC. The scattered light LB is reflected by the first reflective surface 202B of the first reflector 202. If the fixing position PX is at the central axis O in design, the laser light reflected by the first reflective surface 202B (hereinafter referred to as reflected light LD) travels toward the fixing position PX along the incident directions of the scattered light LB on the first reflective surface 202B.

Figure 8:
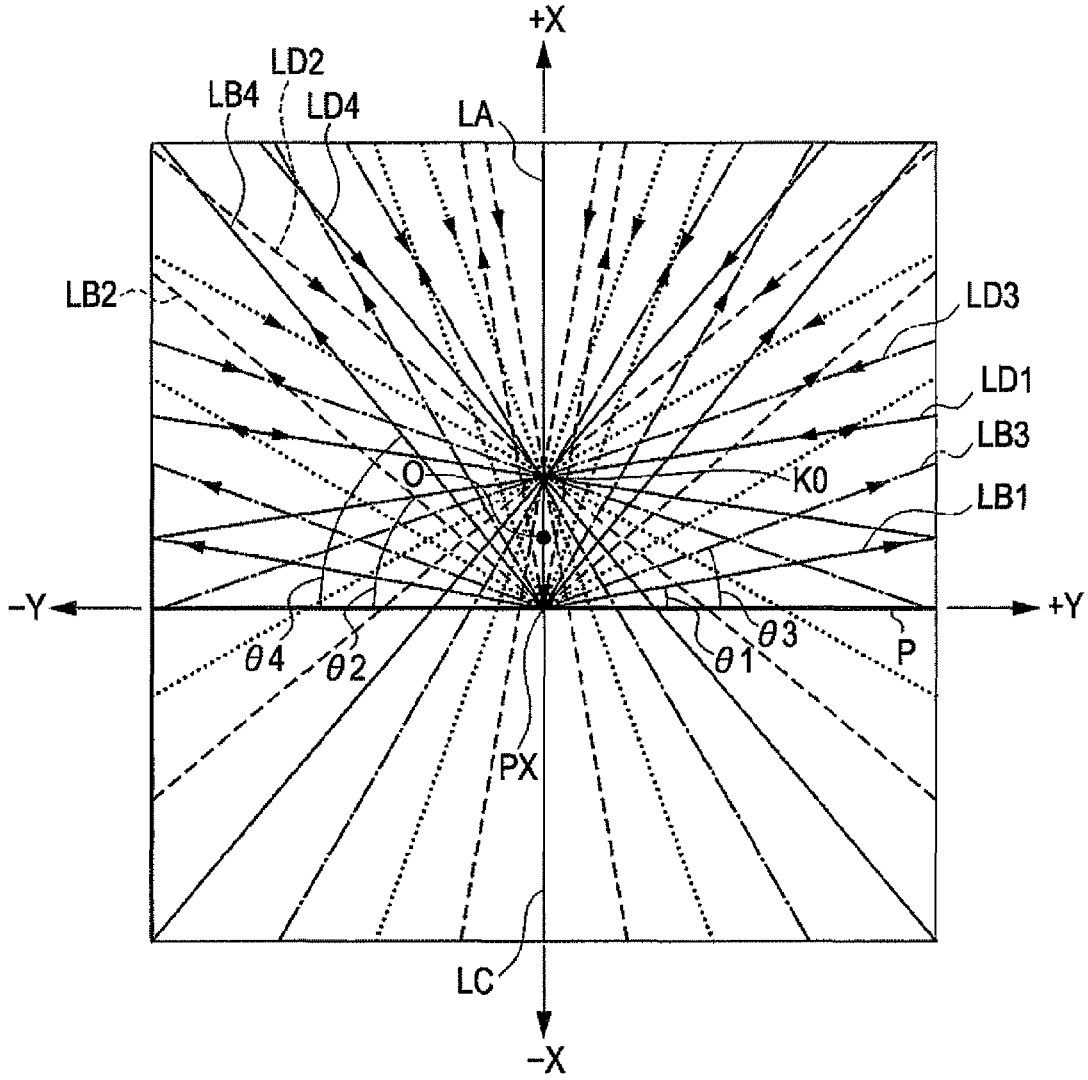
FIG. 8 is a schematic diagram illustrating the state in which the laser light is collected on continuous paper in the fixing apparatus according to the comparative example.

Referring to FIG. 8, in the laser light LA emitted by the laser-light generators 52 (see FIG. 2) in the fixing apparatus 200, a first angular component, a second angular component, a third angular component, and a fourth angular component of the laser light reflected (scattered) by the continuous paper P at the fixing position PX are defined as LB1, LB2, LB3, and LB4, respectively. For example, the first angular component LB1 is a component of the laser light that is reflected in a direction at an angle $\theta 1$ with respect to the +Y direction, and the second angular component LB2 is a component of the laser light that is reflected in a direction at an angle $\theta 2$ ($>\theta 1$) with respect to the −Y direction (direction opposite to the +Y direction). The third angular component LB3 is a component of the laser light that is reflected in a direction at an angle $\theta 3$ ($>\theta 1<\theta 3<\theta 2$) with respect to the +Y direction, and the fourth angular component LB4 is a component of the laser light that is reflected in a direction at an angle $\theta 4$ ($>\theta 1$, $\theta 2$, $\theta 3$) with respect to the −Y direction. Although there are infinite numbers of components in the laser light in practice, the first angular component LB1, the second angular component LB2, the third angular component LB3, and the fourth angular component LB4 will be considered herein.

In addition, in the laser light reflected by the first reflector 202, a component obtained as a result of reflection of the first angular component LB1 by the first reflective surface 202B is defined as a first angular component LD1. Similarly, a component obtained as a result of reflection of the second angular component LB2 by the first reflective surface 202B is defined as a second angular component LD2, a component obtained as a result of reflection of the third angular component LB3 by the first reflective surface 202B is defined as a third angular component LD3, and a component obtained as a result of reflection of the fourth angular component LB4 by the first reflective surface 202B is defined as a fourth angular component LD4. In the fixing apparatus 200, the first angular component LD1, the second angular component LD2, the third angular component LD3, and the fourth angular component LD4 always intersect at a single point in the X-Y plane.

Here, in the fixing apparatus 200 (see FIG. 7), it is assumed that the tension applied to the continuous paper P during conveyance is changed, for example, and the continuous paper P is displaced in the −X direction (direction away from the laser-light generators 52) owing to bending of the continuous paper P or the like. In this case, as illustrated in FIG. 8, the position of the central axis O of the first reflector 202 and the fixing position PX of the laser light LA are shifted from each other. In the X-Y plane, the intersection point of the first angular component LD1 and the third angular component LD3 and the intersection point of the second angular component LD2 and the fourth angular component LD4 are at the same position in the direction of displacement of the continuous paper P (in the −X direction). In other words, components of the laser light that has been reflected at the fixing position PX and then reflected by the first reflector 202 are collected at an intersection point K0 on the optical axis of the laser light LA in the X-Y plane, and travel straight through the intersection point K0. Although the laser light LA is collected in the X-Y plane, the laser light LA is not collected in the Z direction.

Figure 9A:
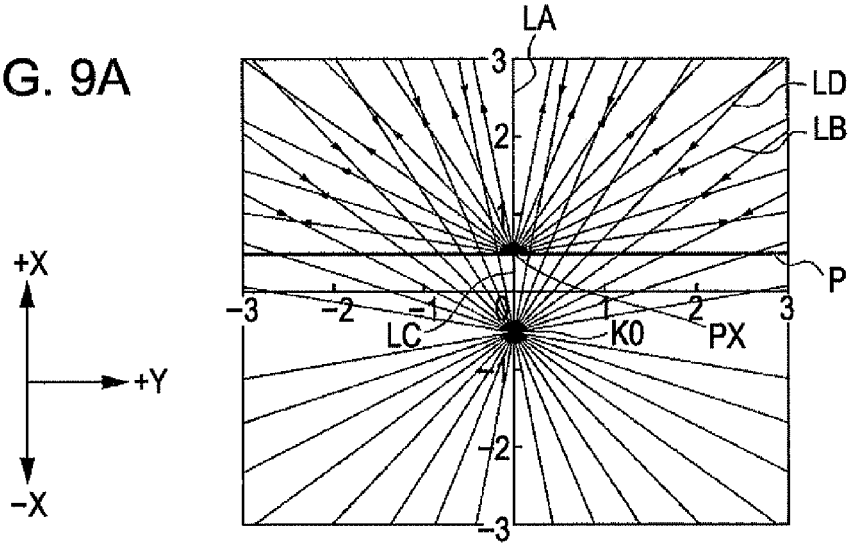
FIGS. 9A, 9B, and 9C are schematic diagrams illustrating the state in which the laser light is reflected by the continuous paper and the laser light reflected by the reflector is collected on the continuous paper in the case where the continuous paper is displaced in a direction perpendicular to a conveying direction in the fixing apparatus according to the comparative example.
Figure 9B:
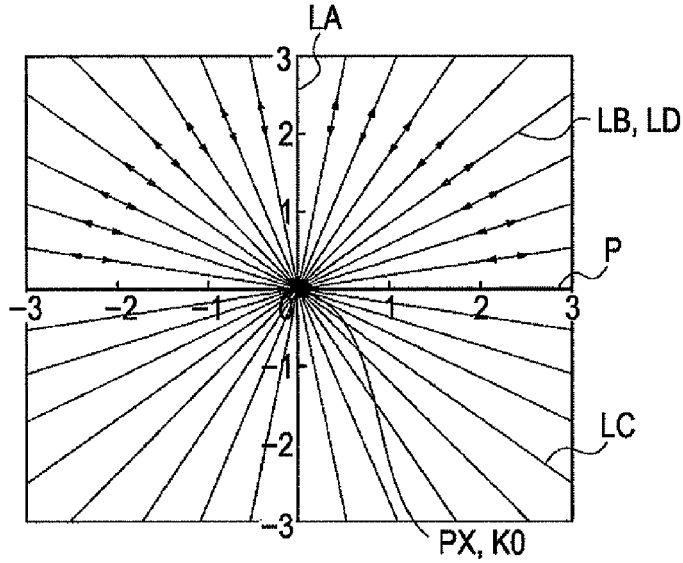

Referring to FIG. 9B, in the fixing apparatus 200, when the continuous paper P is at the position of the above-described central axis O (see FIG. 8) that serves as a reference position of the continuous paper P in the X direction, a part of the laser light LA emitted toward the fixing position PX is reflected by the continuous paper P as the scattered light LB, and the scattered light LB is then reflected by the first reflective surface 202B (see FIG. 7) as the reflected light LD. The reflected light LD is collected at the fixing position PX again. Accordingly, in the X-Y plane, the above-described intersection point K0 is at the same position as the fixing position PX, and the irradiation energy density is increased at the fixing position PX. In other words, optical energy used to heat the toner at the fixing position PX (optical energy applied while the toner on the continuous paper P that is being conveyed passes through the fixing position PX (hereinafter referred to as heating energy)) is increased.

Figure 9C:
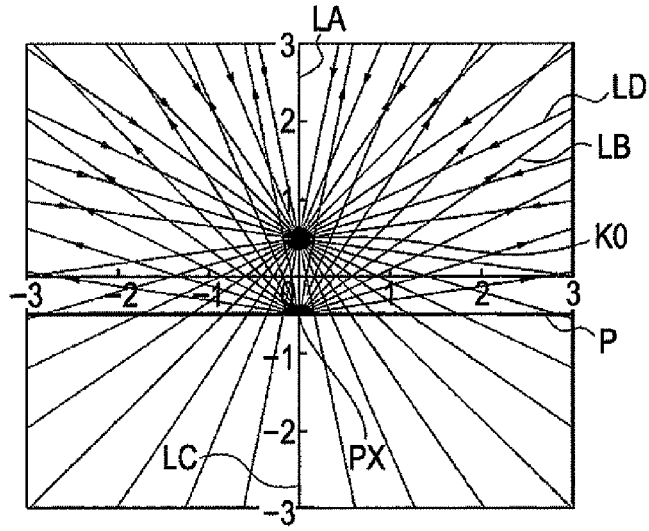

In contrast, referring to FIG. 9A, in the fixing apparatus 200, when the position of the continuous paper P is displaced from the central axis O in the +X direction (direction toward the laser-light generators 52), that is, when the fixing position PX is shifted in the direction, the intersection point K0 of the reflected light LD reflected by the first reflective surface 202B in the X-Y plane is shifted from the central axis O in the −X direction. In addition, referring to FIG. 9C, when the position of the continuous paper P is displaced from the central axis O in the −X direction, that is, when the fixing position PX is shifted in the −X direction, the intersection point K0 of the reflected light LD reflected by the first reflective surface 202B in the X-Y plane is shifted from the central axis O in the +X direction.

Thus, in the fixing apparatus 200 according to the comparative example, the reflected light LD from the first reflective surface 202B is collected at a single intersection point K0 in the X-Y plane.

The operation of the first exemplary embodiment will now be described.

Figure 4:
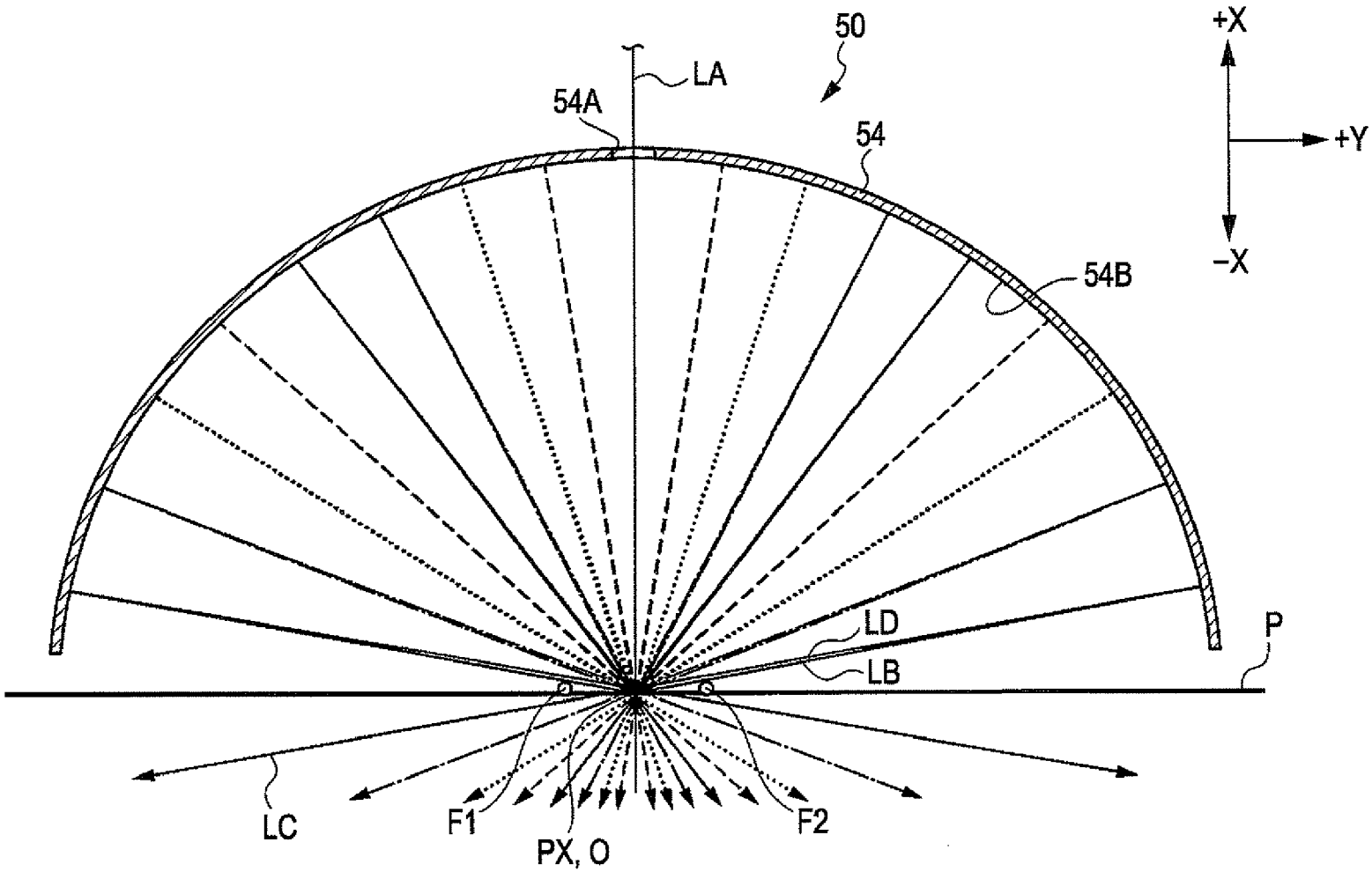
FIG. 4 is a schematic diagram illustrating the state in which laser light is reflected and collected by a reflector included in the fixing apparatus according to the first exemplary embodiment of the present invention.

FIG. 4 illustrates the state in which laser light is reflected and collected in the fixing apparatus 50 (see FIG. 2) according to the first exemplary embodiment. Here, it is assumed that the first reflector 54 and the second reflector 56 (see FIG. 2) have the same shape and dimension and the second reflector 56 is disposed symmetrically to the first reflector 54 with respect to the central axis O in design. Therefore, explanations regarding the reflection of laser light by the second reflector 56 will be omitted, and only the first reflector 54 will be described. In FIG. 4, F1 and F2 show the focal points of the first reflector 54 having the semi-elliptical shape.

In the fixing apparatus 50, when the laser light LA is emitted from the laser-light generators 52 (see FIG. 2) toward the continuous paper P, a part of the laser light LA is reflected at the fixing position PX as the scattered light LB, and another part of the laser light LA passes through the continuous paper P as the transmitted light LC. The scattered light LB is reflected by the first reflective surface 54B of the first reflector 54. If the fixing position PX is at the central axis O in design of the first reflector 54 in the X-Y plane, the laser light reflected by the first reflective surface 54B (hereinafter referred to as reflected light LD) travels toward positions different from the fixing position PX along reflective angle directions corresponding to incident angles of the scattered light LB on the first reflective surface 54B.

Figure 5:
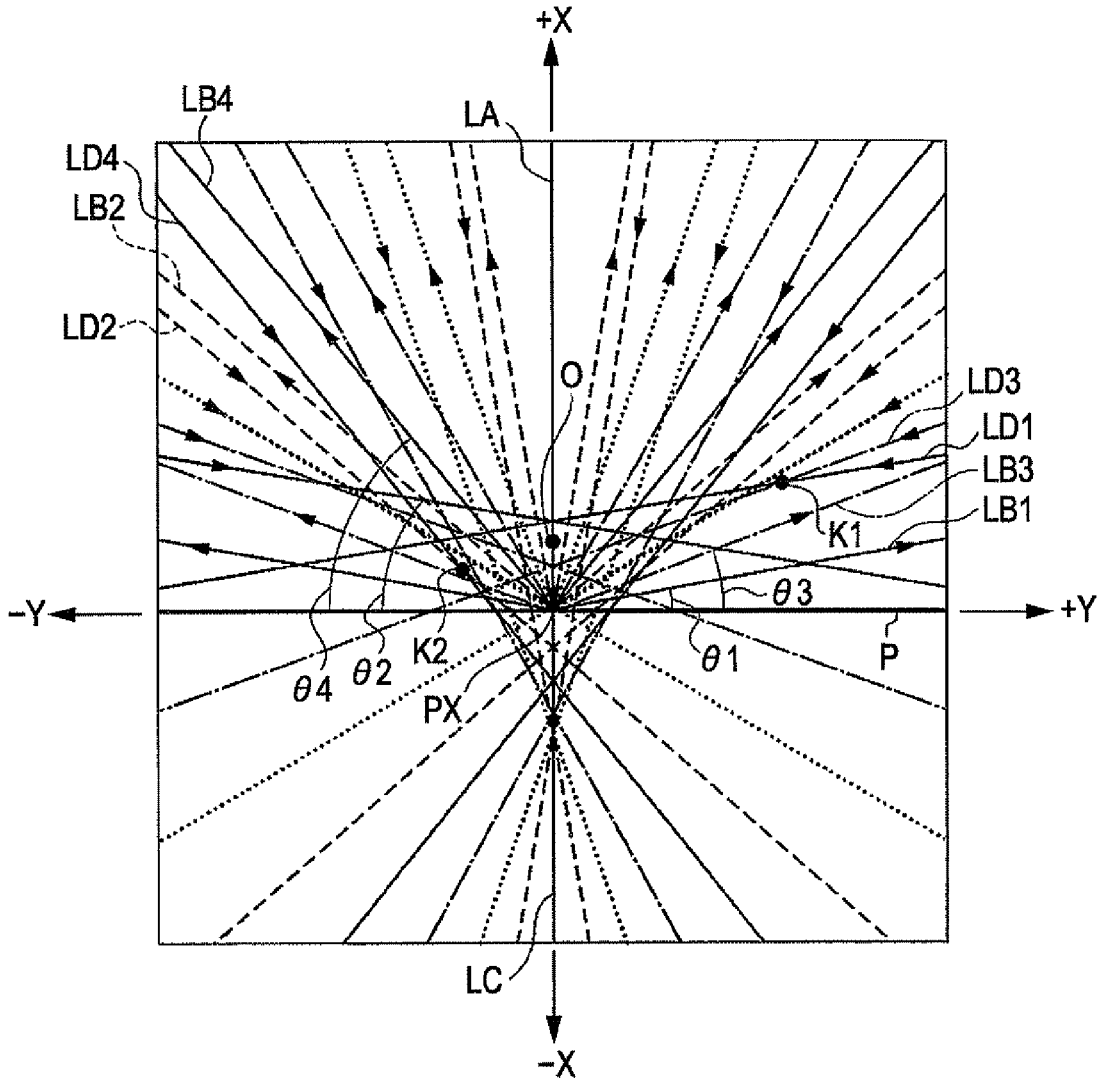
FIG. 5 is a schematic diagram illustrating the state in which the laser light is collected on continuous paper in the fixing apparatus according to the first exemplary embodiment of the present invention.

Referring to FIG. 5, in the laser light LA emitted by the laser-light generators 52 (see FIG. 2) in the fixing apparatus 50, a first angular component, a second angular component, a third angular component, and a fourth angular component of the laser light reflected (scattered) by the continuous paper P at the fixing position PX are defined as LB1, LB2, LB3, and LB4, respectively. For example, the first angular component LB1 is a component of the laser light that is reflected in a direction at an angle θ1 with respect to the +Y direction, and the second angular component LB2 is a component of the laser light that is reflected in a direction at an angle θ2 (>θ1) with respect to the −Y direction. The third angular component LB3 is a component of the laser light that is reflected in a direction at an angle θ3 (θ1<θ3<θ2) with respect to the +Y direction, and the fourth angular component LB4 is a component of the laser light that is reflected in a direction at an angle θ4 (>θ1, θ2, θ3) with respect to the −Y direction. Although there are infinite numbers of components in the laser light in practice, the first angular component LB1, the second angular component LB2, the third angular component LB3, and the fourth angular component LB4 will be considered herein.

In addition, in the laser light reflected by the first reflector 54, a component obtained as a result of reflection of the first angular component LB1 by the first reflective surface 54B is defined as a first angular component LD1. Similarly, a component obtained as a result of reflection of the second angular component LB2 by the first reflective surface 54B is defined as a second angular component LD2, a component obtained as a result of reflection of the third angular component LB3 by the first reflective surface 54B is defined as a third angular component LD3, and a component obtained as a result of reflection of the fourth angular component LB4 by the first reflective surface 54B is defined as a fourth angular component LD4.

Here, in the fixing apparatus 50 (see FIG. 2), it is assumed that the tension applied to the continuous paper P during conveyance is changed, for example, and the continuous paper P is displaced in the −X direction owing to bending of the continuous paper P or the like. In this case, as illustrated in FIG. 5, the position of the central axis O and the fixing position PX of the laser light LA are shifted from each other. In the X-Y plane, a first intersection point K1 at which the first angular component LD1 and the third angular component LD3 of the laser light reflected by the first reflector 54 intersect and a second intersection point K2 at which the second angular component LD2 and the fourth angular component LD4 of the laser light reflected by the first reflector 54 intersect are at different positions in the X and Y directions. In other words, components of the laser light that has been reflected at the fixing position PX and then reflected by the first reflector 54 travel straight through points at different positions in the X and Y directions in the X-Y plane. Since the continuous paper P is conveyed in the Y direction, the X and Y directions are both the directions of displacement of the continuous paper P.

Figure 6A:
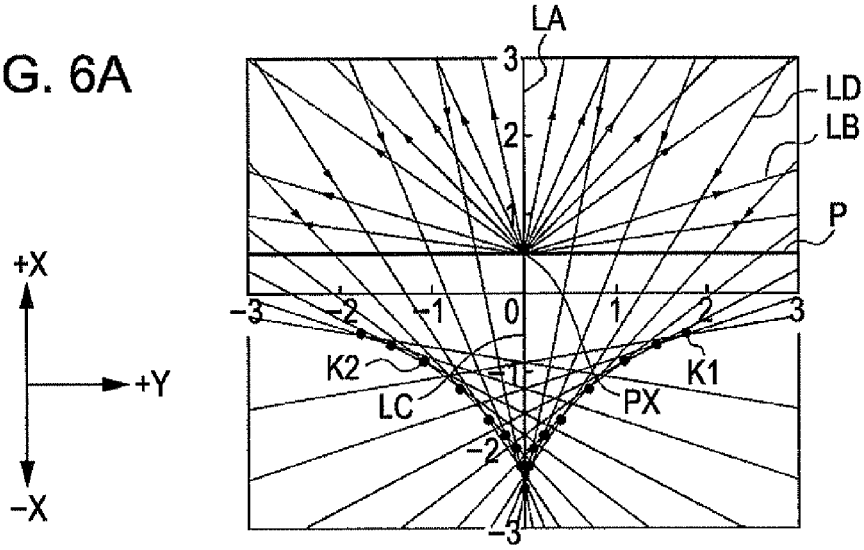
FIGS. 6A, 6B, and 6C are schematic diagrams illustrating the state in which the laser light is reflected by the continuous paper and the laser light reflected by the reflector is collected in the case where the continuous paper is displaced in a direction perpendicular to a conveying direction in the fixing apparatus according to the first exemplary embodiment of the present invention.
Figure 6B:
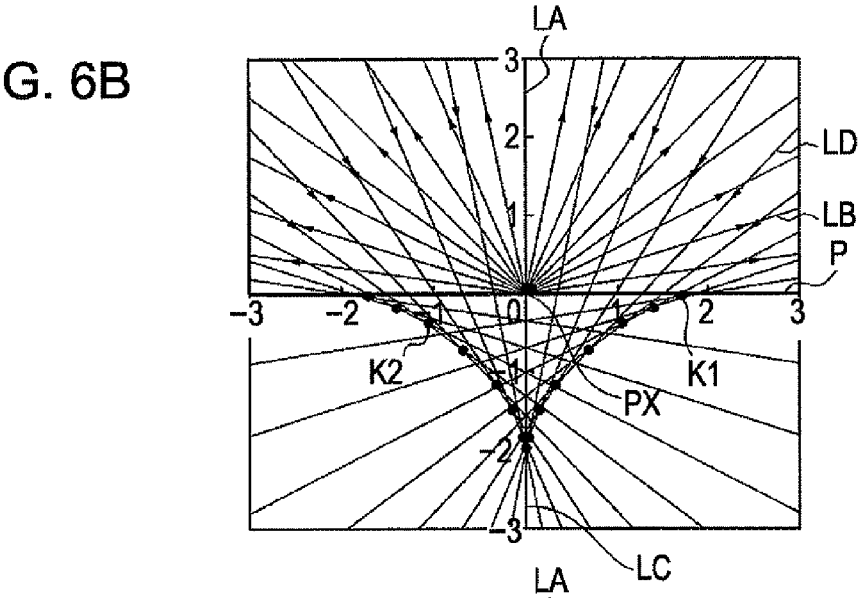

Referring to FIG. 6B, in the fixing apparatus 50, when the continuous paper P is at the position of the above-described central axis O in design (origin (0,0) in FIG. 6B) that serves as the reference position of the continuous paper P in the X direction, a part of the laser light LA emitted toward the fixing position PX is reflected by the continuous paper P as the scattered light LB, and the scattered light LB is then reflected by the first reflective surface 54B (see FIG. 4) as the reflected light LD. Then, the reflected light LD is collected at points (points shown by black dots) including the first intersection point K1 and the second intersection point K2 at positions different from the fixing position PX and from each other in the X-Y plane.

Referring to FIG. 6A, when the position of the continuous paper P is displaced from the central axis O in design in the +X direction, that is, when the fixing position PX is shifted in the +X direction, the first intersection point K1 and the second intersection point K2 of the reflected light LD reflected by the first reflective surface 54B in the X-Y plane are at different positions that are shifted from the fixing position PX in the −X direction and in the +Y or −Y direction.

Figure 6C:
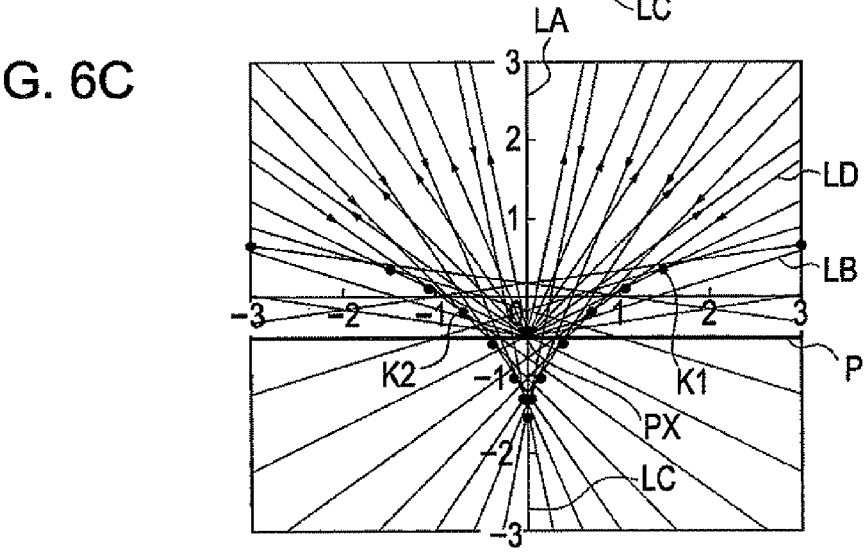

In addition, referring to FIG. 6C, when the position of the continuous paper P is displaced from the central axis O in design in the −X direction, that is, when the fixing position PX is shifted in the −X direction, the first intersection point K1 and the second intersection point K2 of the reflected light LD reflected by the first reflective surface 54B in the X-Y plane are at different positions that are shifted in the +X direction and in the +Y or −Y direction. Thus, in the fixing apparatus 50 according to the first exemplary embodiment, the points (points shown by the black dots including the first intersection point K1 and the second intersection point K2) at which the reflected light LD from the first reflective surface 54B is collected in the X-Y plane are at different positions in the directions of displacement of the continuous paper P.

The difference between the state in which the reflected light LD is collected in the fixing apparatus 50 according to the first exemplary embodiment and the state in which the reflected light LD is collected in the fixing apparatus 200 (see FIG. 7) according to the comparative example will now be discussed. In the fixing apparatus 200 according to the comparative example, the reflected light LD is collected at a single point in the X-Y plane. In contrast, in the fixing apparatus 50 according to the first exemplary embodiment, the reflected light LD is collected at points distributed in the directions of displacement of the continuous paper P in the X-Y plane. In other words, in the fixing apparatus 200 according to the comparative example, the collection area of the reflected light LD is a small area located at substantially a single point in the X-Y plane. In the fixing apparatus 50 according to the first exemplary embodiment, the collection area of the reflected light LD expands in the X and Y directions in the X-Y plane and is broader than that in the fixing apparatus 200 according to the comparative example. Thus, the state in which the reflected light LD is collected differs between the fixing apparatus 200 according to the comparative example and the fixing apparatus 50 according to the first exemplary embodiment.

It is clear from the above description that the irradiation area (hereinafter referred to as a focal depth) of the reflected light LD in the fixing apparatus 50 according to the first exemplary embodiment is broader than that in the fixing apparatus 200 according to the comparative example. Therefore, in the fixing apparatus 50 according to the first exemplary embodiment, optical energy higher than or equal to a certain level may be applied to the toner even when the continuous paper P is displaced. Accordingly, the relationship between the position on the continuous paper P along the Y direction and the light intensity at that position in the case where the continuous paper P is displaced in the X direction is considered for each of the fixing apparatus 50 according to the first exemplary embodiment and the fixing apparatus 200 according to the comparative example.

Figure 10A:
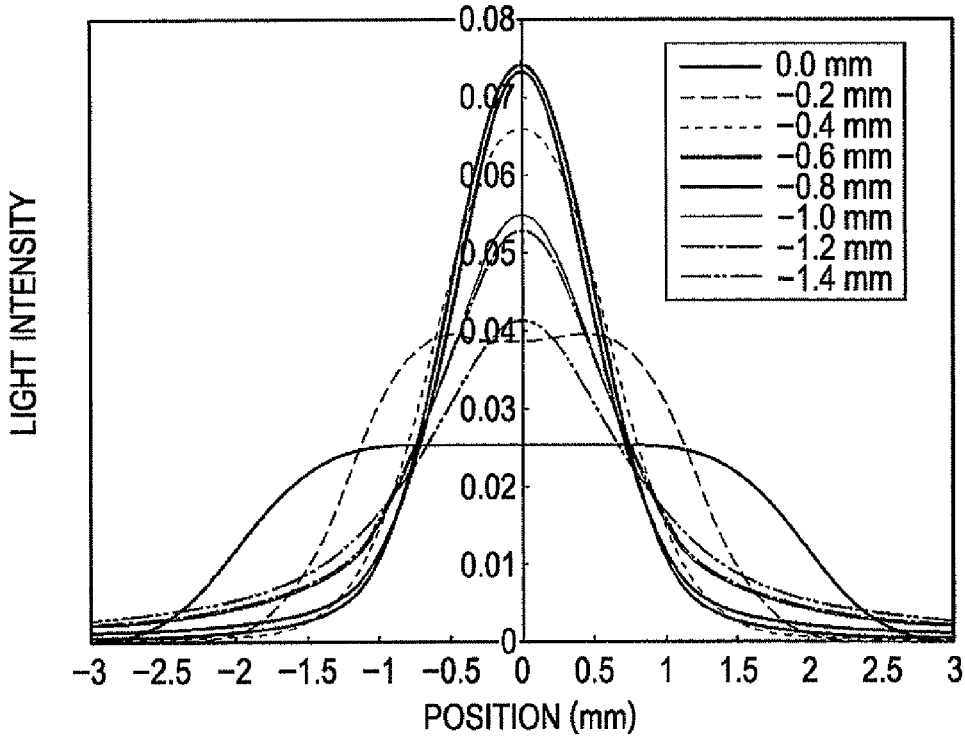
FIG. 10A is a graph of the relationship between the position on the continuous paper along the conveying direction and the light intensity at that position in the case where the continuous paper is displaced in a direction perpendicular to the conveying direction in the fixing apparatus according to the first exemplary embodiment of the present invention.
Figure 10B:
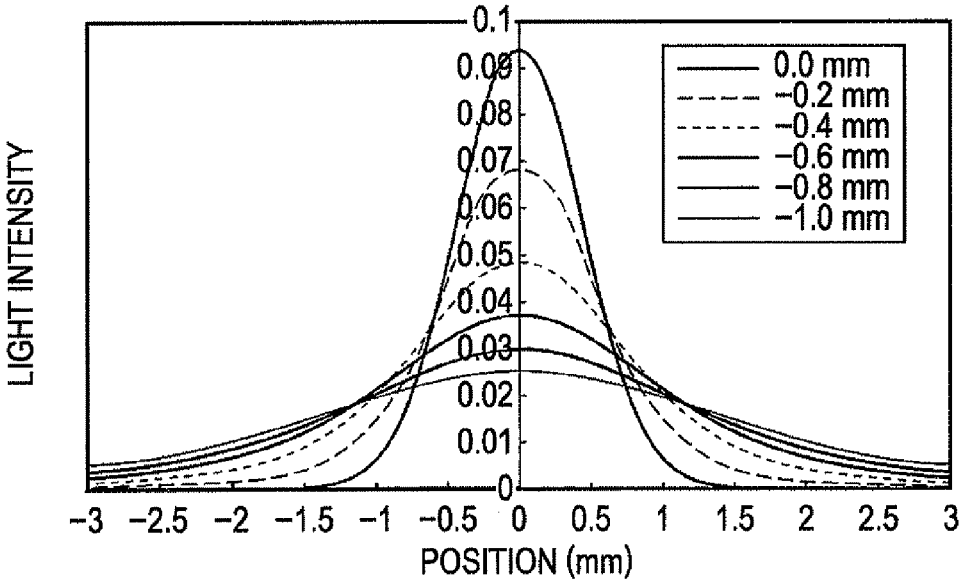
FIG. 10B is a graph of the relationship between the position on the continuous paper along the conveying direction and the light intensity at that position in the case where the continuous paper is displaced in a direction perpendicular to the conveying direction in the fixing apparatus according to the comparative example.

FIG. 10A illustrates the light intensity distribution in the fixing apparatus 50 according to the first exemplary embodiment. FIG. 10B illustrates the light intensity distribution in the fixing apparatus 200 according to the comparative example. With regard to the fixing apparatus 50, the light intensity distribution is measured for each of the cases where the continuous paper P is displaced from the reference position corresponding to the central axis O in design (K=0.0 mm) to X=−0.2 mm, −0.4 mm, −0.6 mm, −0.8 mm, −1.0 mm, −1.2 mm, and −1.4 mm. With regard to the fixing apparatus 200, the light intensity distribution is measured for each of the cases where the continuous paper P is displaced from the reference position (X=0.0 mm) to X=−0.2 mm, −0.4 mm, −0.6 mm, −0.8 mm, and −1.0 mm.

Referring to FIGS. 10A and 10B, the light intensity distribution in the fixing apparatus 50 according to the first exemplary embodiment and the light intensity distribution in the fixing apparatus 200 according to the comparative example will be compared with each other within a range in which the displacement of the continuous paper P is in the range of 0.0 mm to −1.0 mm. In the fixing apparatus 200 according to the comparative example, the light intensity is about 0.095 at the reference position, and is reduced to about 0.025 at −1.0 mm. Thus, the reduction percentage of the light intensity relative to the light intensity at the reference position is about 75%.

In the light intensity distribution in the fixing apparatus 50 according to the first exemplary embodiment, the light intensity is about 0.025 at the reference position, and is increased to about 0.055 at −1.0 mm. Thus, the reduction percentage of the light intensity at the reference position relative to the light intensity at −1.0 mm is about 55%. Thus, variation in the light intensity, that is, variation in the density of irradiation energy applied to the toner on the continuous paper P and the heating energy applied to the toner, caused when the continuous paper P is displaced, is smaller in the fixing apparatus 50 according to the first exemplary embodiment than in the fixing apparatus 200 according to the comparative example.

Figure 11A:
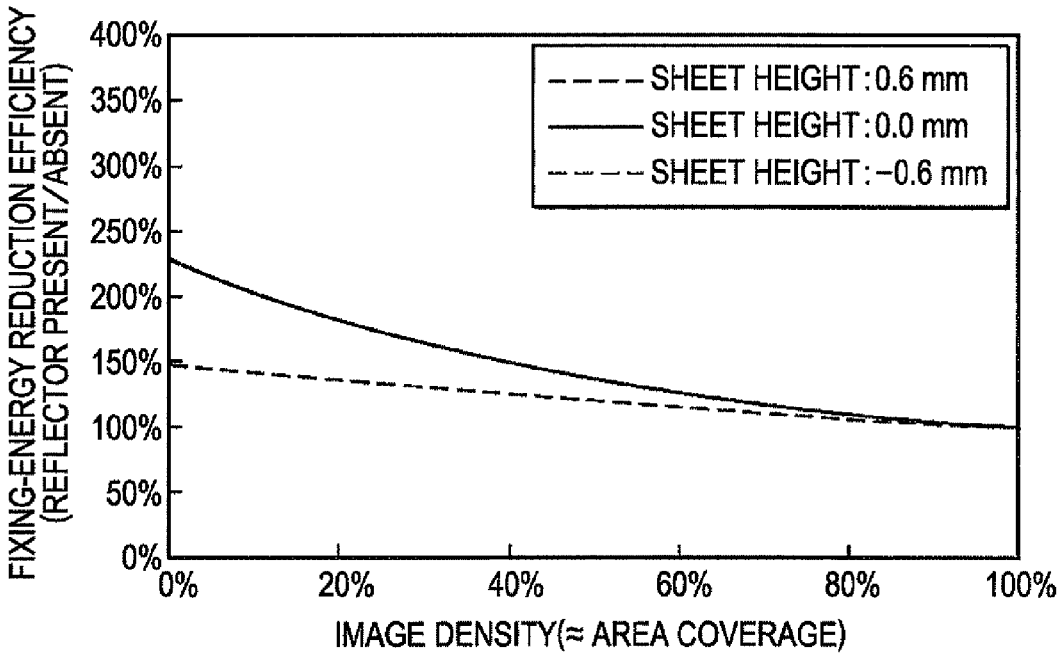
FIG. 11A is a graph of the relationship between the image density on the continuous paper and the fixing-energy reduction efficiency in the case where the continuous paper is displaced in a direction perpendicular to the conveying direction in the fixing apparatus according to the first exemplary embodiment of the present invention.
Figure 11B:
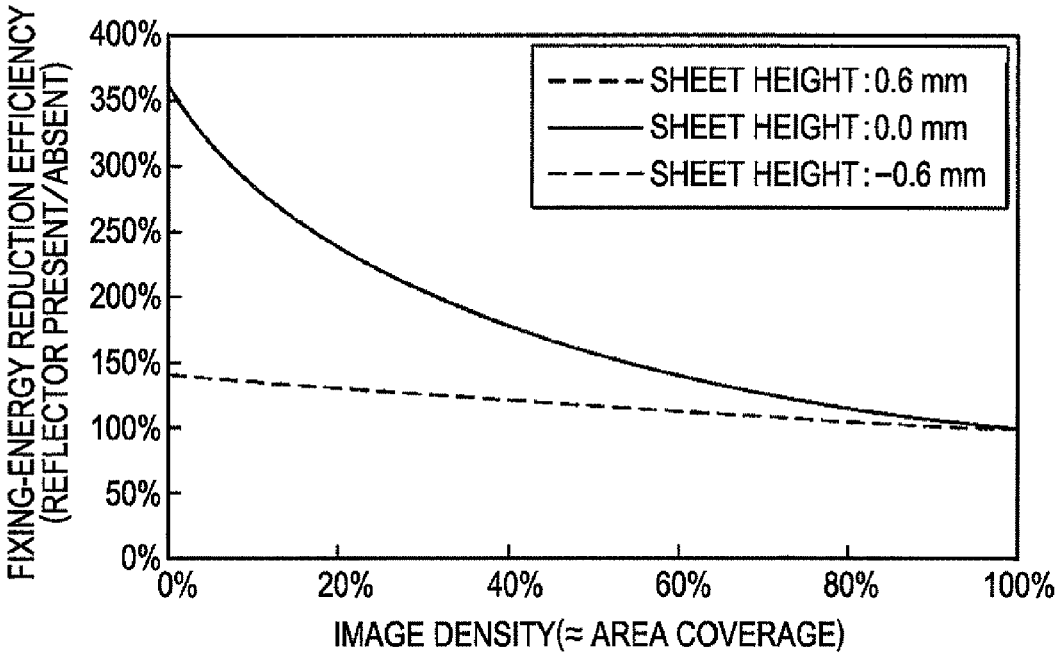
FIG. 11B is a graph of the relationship between the image density on the continuous paper and the fixing-energy reduction efficiency in the case where the continuous paper is displaced in a direction perpendicular to the conveying direction in the fixing apparatus according to the comparative example.

FIGS. 11A and 11B are graphs illustrating the relationship between the density of the toner image on the continuous paper P and the fixing-energy reduction efficiency in the cases where a sheet height at which the continuous paper P is positioned (position in the X direction) is set to 0.0 mm, +0.6 mm, and −0.6 mm in the fixing apparatus 50 according to the first exemplary embodiment and the fixing apparatus 200 according to the comparative example, respectively. In FIGS. 11A and 11B, the vertical axis shows the fixing-energy reduction efficiency, which is the percentage of the heating energy applied to the toner when the reflectors for reflecting the scattered light LB from the fixing position PX are present relative to the heating energy applied to the toner when the reflectors are absent. The percentage for when the reflectors are absent is defined as 100%. The horizontal axis shows the image density, which is the percentage of the area covered by the toner per unit area of the continuous paper P.

As illustrated in FIG. 11B, in the fixing apparatus 200 according to the comparative example, the fixing-energy reduction efficiency is in the range of about 120% to 140% when the sheet height at which the continuous paper P is positioned is +0.6 mm or −0.6 mm. When the sheet height at which the continuous paper P is positioned is 0.0 mm, the fixing-energy reduction efficiency largely varies in the range of about 120% to 350%. This shows that the density of irradiation energy applied to the toner and the heating energy applied to the toner largely vary in accordance with a variation in the sheet height at which the continuous paper P is positioned. Therefore, if, for example, the irradiation energy is set to a high level based on the case in which the continuous paper P is displaced, excessive heating energy will be applied to the toner when the continuous paper P is not displaced. As a result, the image quality will be degraded. In addition, if the irradiation energy is set to a low level based on the case in which the continuous paper P is not displaced, sufficient heating energy cannot be applied to the toner when the continuous paper P is displaced. As a result, fixing performance will be degraded.

As illustrated in FIG. 11A, in the fixing apparatus 50 according to the first exemplary embodiment, the fixing-energy reduction efficiency is in the range of about 120% to 150% when the sheet height at which the continuous paper P is positioned is +0.6 mm or −0.6 mm. When the sheet height at which the continuous paper P is positioned is 0.0 mm, the fixing-energy reduction efficiency varies in the range of about 120% to 230%. Thus, in the case where the fixing apparatus 50 according to the first exemplary embodiment is used, compared to the case in which the fixing apparatus 200 according to the comparative example is used, variation in the heating energy applied to the toner on the continuous paper P relative to the displacement of the continuous paper P is small. In other words, sufficient heating energy may be applied to the toner and application of excessive heating energy may be prevented. Therefore, stable toner-fixing performance and image quality may be provided.

As described above, in the fixing apparatus 200 according to the comparative example, the reflected light LD is collected at a single point on the X-Y plane. In this structure, if the irradiation energy is set to a high level so that heating energy sufficient to fix the toner may be applied to the toner even when the continuous paper P is displaced, excessive heating energy is applied to the toner on the continuous paper P when the central axis O in design coincides with the fixing position PX. As a result, the image quality will be degraded. In addition, if the irradiation energy is set to a low level based on the case in which the continuous paper P is not displaced, sufficient heating energy cannot be applied to the toner when the continuous paper P is displaced. As a result, fixing performance will be degraded.

In contrast, in the fixing apparatus 50 according to the first exemplary embodiment, components of the reflected light LD reflected by the first reflector 54 intersect at different points in the directions of displacement of the continuous paper P in the X-Y plane. Therefore, the laser light is not collected at a certain position but is somewhat collected within a range in which the continuous paper P is displaced. Therefore, in the fixing apparatus 50, irrespective of whether the central axis O in design coincides with or differs from the fixing position PX (irrespective of whether or not the continuous paper P is displaced), sufficient heating energy may be applied to the toner on the continuous paper P and application of excessive heating energy may be prevented. As a result, degradation in the performance of fixing the toner on the continuous paper P and degradation in the image quality may be suppressed.

In the fixing apparatus 50 illustrated in FIG. 3, the image formed by the toner T applied to the continuous paper P generally includes high-image-density areas and low-image-density areas. In the fixing apparatus 50 according to the first exemplary embodiment, the area in which the continuous paper P is irradiated with the laser light LA has a small width, which is about 1 mm, in the conveying direction of the continuous paper P. In the case where the image density in the area in which the continuous paper P is irradiated with the laser light LA is high, most of the irradiation energy is absorbed by the toner T. Therefore, the amount of scattered light LB is small, and accordingly the irradiation energy of the reflected light LD that is re-directed to the fixing position PX is also small. In the case where the image density in the area in which the continuous paper P is irradiated with the laser light LA is low, the amount of the scattered light LB reflected by the continuous paper P and the amount of the transmitted light LC that passes through the continuous paper P increase. Accordingly, the amount of irradiation energy that is reapplied to the toner T and the amount of irradiation energy that is re-directed to the fixing position PX at the back side of the continuous paper P increase. As a result, the fixing operation may be reliably performed in both of the areas in which the image density is high and the areas in which the image density is low.

In the fixing apparatus 50, the second reflector 56 also has a semi-elliptical shape. Therefore, similar to the first reflector 54, components of the transmitted light LC that is re-directed toward the fixing position PX intersect at different points in the directions of displacement of the continuous paper P in the X-Y plane. Therefore, the laser light is not collected at a certain position but is somewhat collected within a range in which the continuous paper P is displaced. Therefore, degradation in the performance of fixing the toner on the continuous paper P and degradation in the image quality may be further suppressed.

A fixing apparatus and an image forming apparatus according to a second exemplary embodiment of the present invention will now be described. Components similar to those in the first exemplary embodiment are denoted by the same reference numerals, and explanations thereof are thus omitted.

Figure 12:
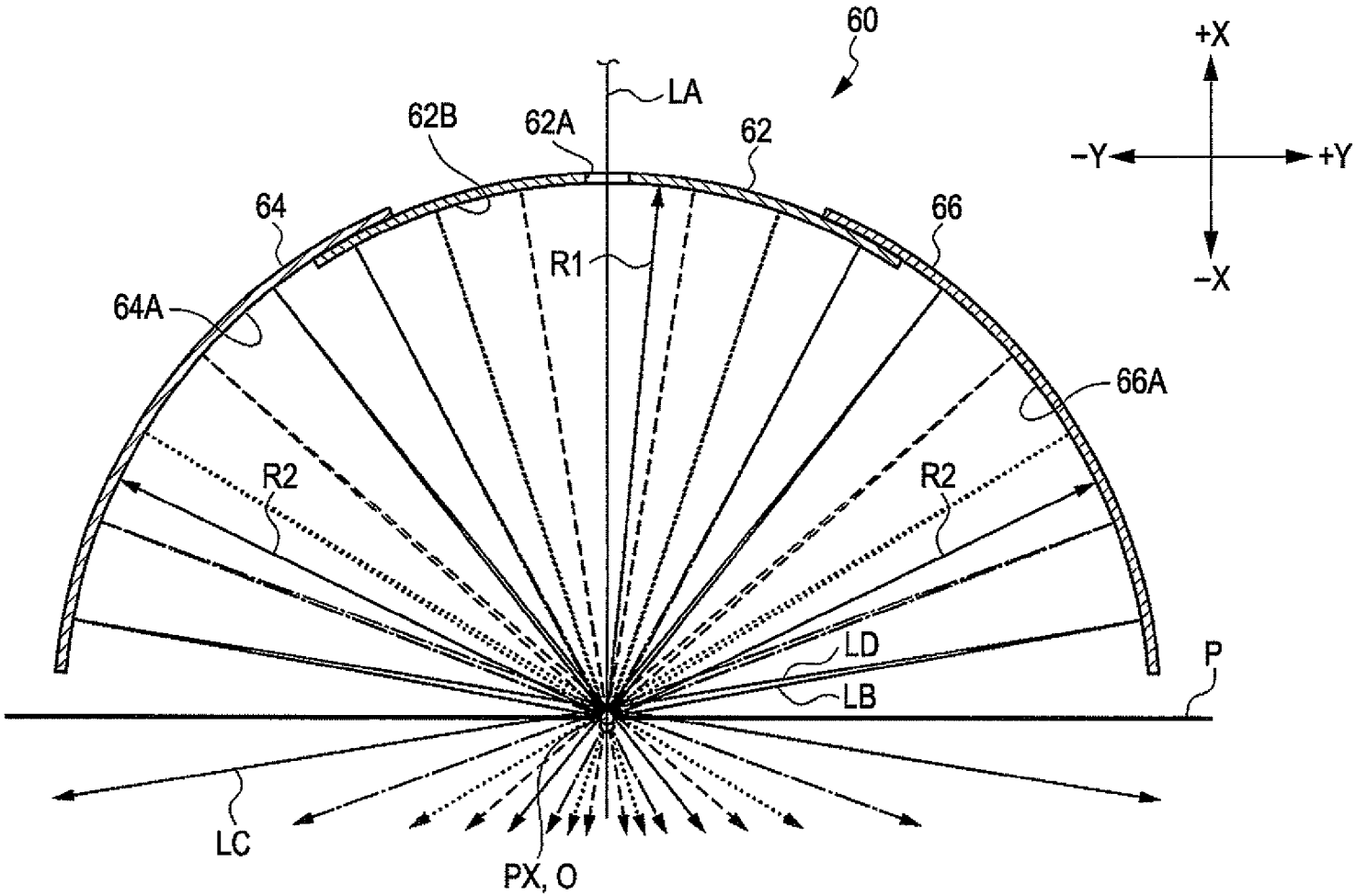
FIG. 12 is a schematic diagram illustrating the state in which laser light is reflected and collected by reflectors included in a fixing apparatus according to a second exemplary embodiment of the present invention.

FIG. 12 illustrates a fixing apparatus 60 according to the second exemplary embodiment. The fixing apparatus 60 includes the laser-light generators 52 (not shown), a third reflector 62, a fourth reflector 64, a fifth reflector 66, and a second reflector (not shown). The third, fourth, and fifth reflectors 62, 64, and 66 are an example of arc members or reflectors that reflect the scattered light LB, which is generated when a part of the laser light LA is reflected by the continuous paper P, toward the continuous paper P. The second reflector reflects the transmitted light LC, which is generated when a part of the laser light LA passes through the continuous paper P, toward the continuous paper P. Here, it is assumed that the third, fourth, and fifth reflectors 62, 64, and 66 have the same shape and dimension as those of the second reflector, and the second reflector is disposed symmetrically to the third, fourth, and fifth reflectors 62, 64, and 66 with respect to the central axis O in design. Therefore, explanations regarding the reflection of laser light by the second reflector will be omitted, and only the third, fourth, and fifth reflectors 62, 64, and 66 will be described.

The third reflector 62 is formed of a metal mirror having an arc shape with a radius of R1 in cross section in the X-Y plane. The length of the arc is about one-third of the length of a semicircle centered on the laser light LA (central angle is about 60°). The third reflector 62 is shaped such that the longitudinal direction thereof coincides with the Z direction (direction perpendicular to FIG. 12), and is disposed such that a third reflective surface 62B, which is a concave surface, faces the image surface of the continuous paper P.

The central axis in design at the center of a circle on which the third reflector 62 is positioned in the X-Y plane (point F3 in FIG. 13) is on the −X side of the continuous paper P in the state in which the continuous paper P is stationary without being bent or displaced in the X direction. Accordingly, the third reflector 62 collects a large amount of the scattered light LB reflected by the continuous paper P at a position on the −X side of the fixing position PX.

The third reflective surface 62B is disposed so as to cover a fixing position PX of the laser light LA and to cover the image area of the continuous paper P over the entire width thereof in the Z direction. A light entrance 62A is formed in the third reflective surface 62B at a central area thereof in the circumferential direction such that the longitudinal direction of the light entrance 62A coincides with the Z direction. Accordingly, the laser light LA emitted from the laser-light generators 52 (see FIG. 2) toward the continuous paper P passes through the light entrance 62A and is incident on the image surface of the continuous paper P.

The fourth reflector 64 is formed of a metal mirror having an arc shape with a radius of R2 (>R1) in cross section in the X-Y plane. The length of the arc is about one-third of the length of a semicircle centered on the laser light LA (central angle is about 60°). The fourth reflector 64 is shaped such that the longitudinal direction thereof coincides with the Z direction (direction perpendicular to FIG. 12), and is disposed such that a fourth reflective surface 64A, which is a concave surface, obliquely faces the image surface of the continuous paper P at the left side in FIG. 12. An upper right edge portion of the fourth reflector 64 overlaps a lower left edge portion of the third reflector 62.

The fourth reflective surface 64A is disposed so as to cover the image area of the continuous paper P over the entire width thereof in the Z direction. The central axis (which corresponds to point F4 in FIG. 13) of the fourth reflector 64 in the X-Y plane is at the central axis O in design. Accordingly, the fourth reflector 64 collects a large amount of the scattered light LB reflected by the continuous paper P at the fixing position PX (central axis O) or a position near the fixing position PX.

Similarly, the fifth reflector 66 is formed of a metal mirror having an arc shape with a radius of R2 (>R1) in cross section in the X-Y plane. The length of the arc is about one-third of the length of a semicircle centered on the laser light LA (central angle is about 60°). The fifth reflector 66 is shaped such that the longitudinal direction thereof coincides with the Z direction (direction perpendicular to FIG. 12), and is disposed such a fifth reflective surface 66A, which is a concave surface, obliquely faces the image surface of the continuous paper P at the right side in FIG. 12. An upper left edge portion of the fifth reflector 66 overlaps a lower right edge portion of the third reflector 62.

The fifth reflective surface 66A is disposed so as to cover the image area of the continuous paper P over the entire width thereof in the Z direction. The central axis (which corresponds to point F4 in FIG. 13) of the fifth reflector 66 in the X-Y plane is at the central axis O in design. Accordingly, the fifth reflector 66 collects a large amount of the scattered light LB reflected by the continuous paper P at the fixing position PX (central axis O) or a position near the fixing position PX. Thus, in the fixing apparatus 60, the third, fourth, and fifth reflective surfaces 62B, 64A, and 66A, which have different sizes in the radial direction, are arranged at positions shifted from each other in the directions of displacement of the continuous paper P.

Figure 13:
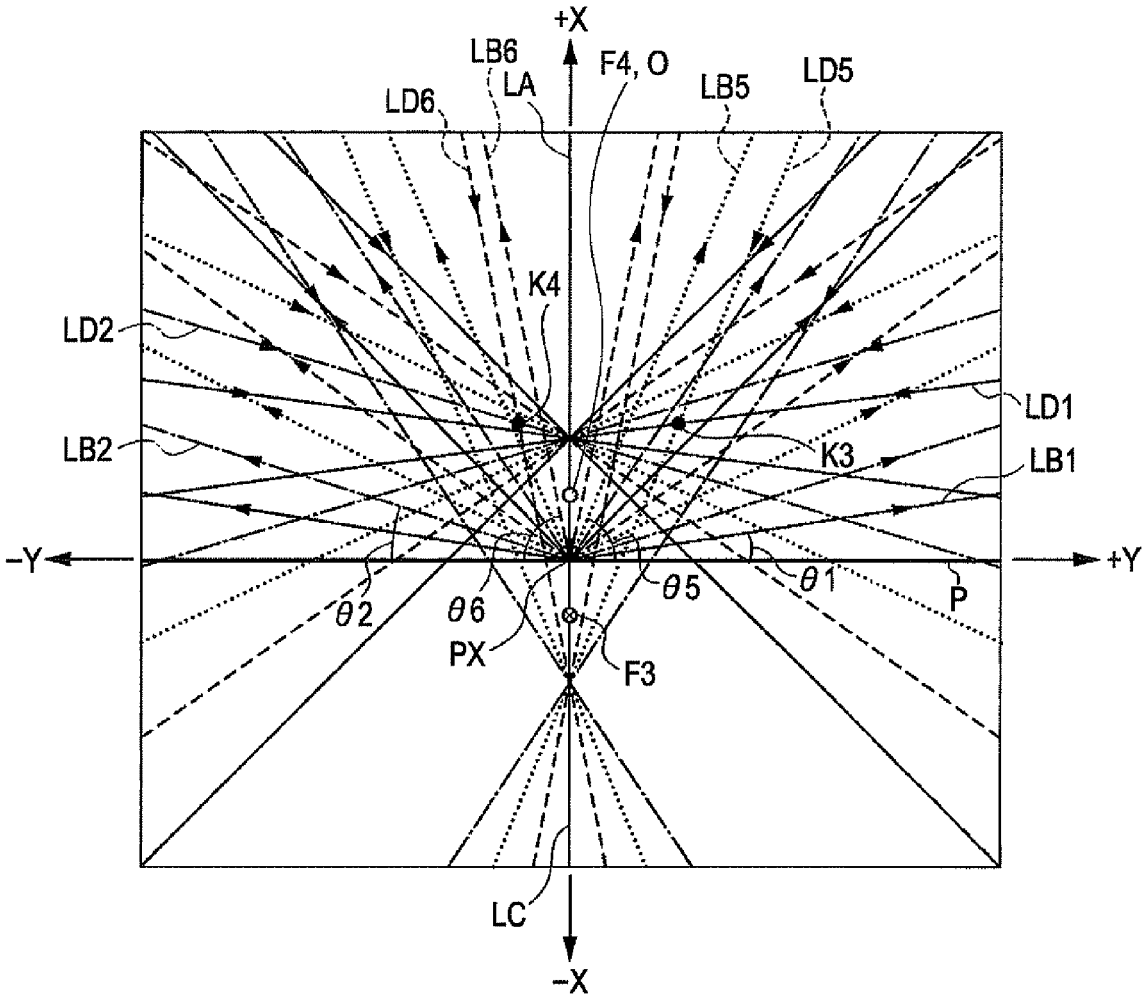
FIG. 13 is a schematic diagram illustrating the state in which the laser light is collected on continuous paper in the fixing apparatus according to the second exemplary embodiment of the present invention.

Referring to FIG. 13, in the laser light LA emitted by the laser-light generators 52 (see FIG. 2) in the fixing apparatus 60, a first angular component, a second angular component, a third angular component, and a fourth angular component of the laser light reflected (scattered) by the continuous paper P at the fixing position PX are defined as LB1, LB2, LB5, and LB6, respectively. For example, the first angular component LB1 is a component of the laser light that is reflected in a direction at an angle θ1 with respect to the +Y direction, and the second angular component LB2 is a component of the laser light that is reflected in a direction at an angle θ(>θ1) with respect to the −Y direction. The third angular component LB5 is a component of the laser light that is reflected in a direction at an angle θ5 (>θ1, θ2) with respect to the +Y direction, and the fourth angular component LB6 is a component of the laser light that is reflected in a direction at an angle θ(>θ5) with respect to the −Y direction. Although there are infinite numbers of components in the laser light in practice, the first angular component LB1, the second angular component LB2, the third angular component LB5, and the fourth angular component LB6 will be considered herein.

In addition, in the laser light reflected by the third reflector 62, a component obtained as a result of reflection of the third angular component LB5 by the third reflective surface 62B is defined as a third angular component LD5, and a component obtained as a result of reflection of the fourth angular component LB6 by the third reflective surface 62B is defined as a fourth angular component LD6. In the laser light reflected by the fourth reflector 64, a component obtained as a result of reflection of the second angular component LB2 by the fourth reflective surface 64A is defined as a second angular component LD2. In the laser light reflected by the fifth reflector 66, a component obtained as a result of reflection of the first angular component LB1 by the fifth reflective surface 66A is defined as a first angular component LD1.

The operation of the second exemplary embodiment will now be described.

As illustrated in FIG. 12, in the fixing apparatus 60, when the laser light LA is emitted from the laser-light generators 52 (see FIG. 3) toward the continuous paper P, a part of the laser light LA is reflected at the fixing position PX as the scattered light LB, and another part of the laser light LA passes through the continuous paper P as the transmitted light LC. The scattered light LB is reflected by the third, fourth, and fifth reflective surfaces 62B, 64A, and 66A. If the fixing position PX is at the central axis O in design, the reflected light LD reflected by the third reflective surface 62B travels toward positions different from the fixing position PX along reflective angle directions corresponding to the incident angles of the scattered light LB. Similarly, the reflected light LD reflected by the fourth reflective surface 64A and the fifth reflective surface 66A travels toward the fixing position PX along reflective angle directions corresponding to the incident angles of the scattered light LB.

Here, in the fixing apparatus 60, it is assumed that the tension applied to the continuous paper P during conveyance is changed, for example, and the continuous paper P is displaced in the −X direction owing to bending of the continuous paper P or the like. In this case, as illustrated in FIG. 13, the position of the central axis O and the fixing position PX of the laser light LA are shifted from each other. In the X-Y plane, a first intersection point K3 at which the first angular component LD1 of the laser light reflected by the fifth reflector 66 and the third angular component LD5 of the laser, light reflected by the third reflector 62 intersect and a second intersection point K4 at which the second angular component LD2 of the laser light reflected by the fourth reflector 64 and the fourth angular component LD6 of the laser light reflected by the third reflector 62 intersect are at different positions in the X and Y directions. In other words, components of the laser light that has been reflected at the fixing position PX and then reflected by the third, fourth, and fifth reflectors 62, 64, and 66 travel straight through points at different positions in the X and Y directions in the X-Y plane.

Figure 14A:
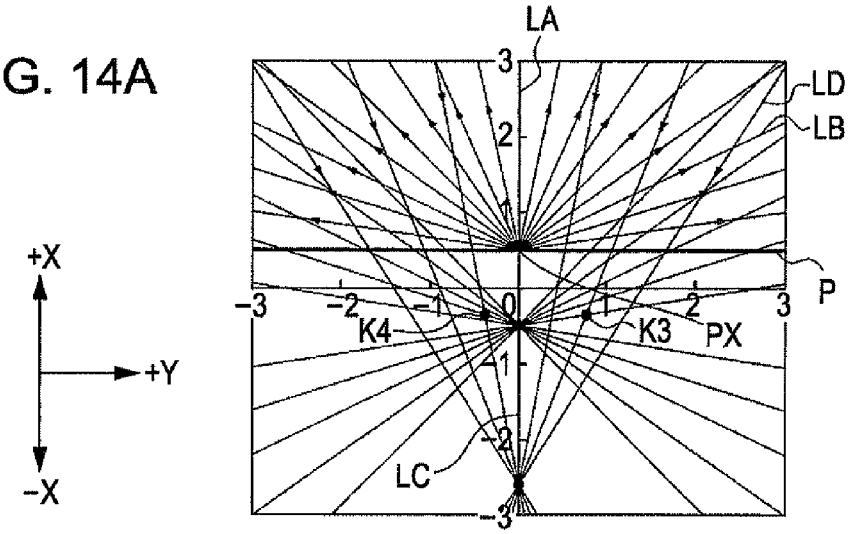
FIGS. 14A, 14B, and 14C are schematic diagrams illustrating the state in which the laser light is reflected by the continuous paper and the laser light reflected by the reflectors is collected on the continuous paper in the case where the continuous paper is displaced in a direction perpendicular to a conveying direction in the fixing apparatus according to the second exemplary embodiment of the present invention.
Figure 14B:
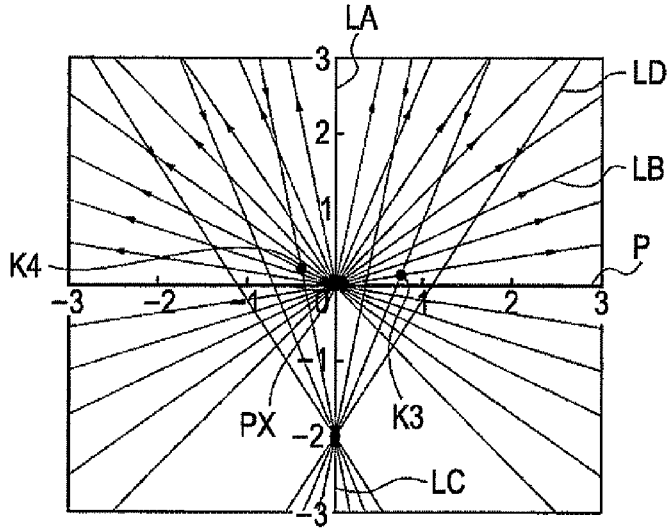

Referring to FIG. 14B, in the fixing apparatus 60, when the continuous paper P is at the central axis O in design (origin (0,0) in FIG. 14B) in the X direction, a part of the laser light LA emitted toward the fixing position PX is reflected by the continuous paper P as the scattered light LB, and the scattered light LB is then reflected by the third, fourth, and fifth reflectors 62, 64, and 66 as the reflected light LD. The reflected light LD reflected by the third and fifth reflectors 62 and 66 is collected at points including the first intersection point K3 at positions different from the fixing position PX in the X-Y plane. The reflected light LD from the third and fourth reflectors 62 and 64 is collected at points including the second intersection point K4 at positions different from the fixing position PX in the X-Y plane.

Referring to FIG. 14A, when the position of the continuous paper P is displaced from the central axis O in design in the +X direction, that is, when the fixing position PX is shifted in the +X direction, the first intersection point K3 of the reflected light LD reflected by the third and fifth reflectors 62 and 66 and the second intersection point K4 of the reflected light LD reflected by the third and fourth reflectors 62 and 64 are at different positions that are shifted from the fixing position PX in the −X direction in the X-Y plane.

Figure 14C:
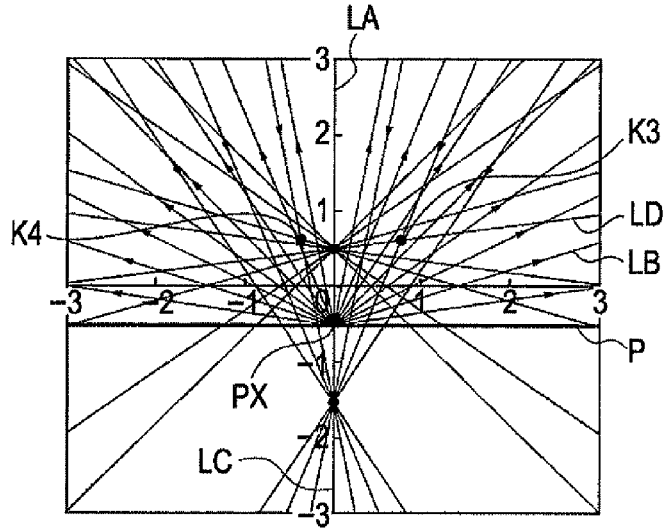

In addition, referring to FIG. 14C, when the position of the continuous paper P is displaced from the central axis O in design in the −X direction, that is, when the fixing position PX is shifted in the −X direction, the first intersection point K3 of the reflected light LD reflected by the third and fifth reflectors 62 and 66 and the second intersection point K4 of the reflected light LD reflected by the third and fourth reflectors 62 and 64 are at different positions that are shifted from the fixing position PX in the +X direction in the X-Y plane. Thus, in the fixing apparatus 60 according to the second exemplary embodiment, the light collecting points including the first intersection point K3 and the second intersection point K4, at which the reflected light LD from the third, fourth, and fifth reflectors 62, 64, and 66 is collected, are at different positions in the directions of displacement of the continuous paper P in the X-Y plane.

The difference between the state in which the reflected light LD is collected in the fixing apparatus 60 according to the second exemplary embodiment and the state in which the reflected light LD is collected in the fixing apparatus 200 (see FIG. 7) according to the comparative example will now be discussed. In the fixing apparatus 200 according to the comparative example, the reflected light LD is collected at a single point in the X-Y plane. In contrast, in the fixing apparatus 60 according to the second exemplary embodiment, the reflected light LD is collected at points distributed in the directions of displacement of the continuous paper P in the X-Y plane. In other words, in the fixing apparatus 200 according to the comparative example, the collection area of the reflected light LD is a small area located at substantially a single point in the X-Y plane. In the fixing apparatus 60 according to the second exemplary embodiment, the collection area of the reflected light LD expands in the X and Y directions in the X-Y plane and is broader than that in the fixing apparatus 200 according to the comparative example. Thus, the state in which the reflected light LD is collected differs between the fixing apparatus 200 according to the comparative example and the fixing apparatus 60 according to the second exemplary embodiment.

It is clear from the above description that the focal depth of the reflected light LD in the fixing apparatus 60 according to the second exemplary embodiment is broader than that in the fixing apparatus 200 according to the comparative example when the continuous paper P is displaced. Therefore, in the fixing apparatus 60 according to the second exemplary embodiment, optical energy higher than or equal to a certain level may be applied to the toner even when the continuous paper P is displaced. Accordingly, the relationship between the position on the continuous paper P along the Y direction and the light intensity at that position in the case where the continuous paper P is displaced in the X direction is considered for each of the fixing apparatus 60 according to the second exemplary embodiment and the fixing apparatus 200 according to the comparative example.

Figure 15A:
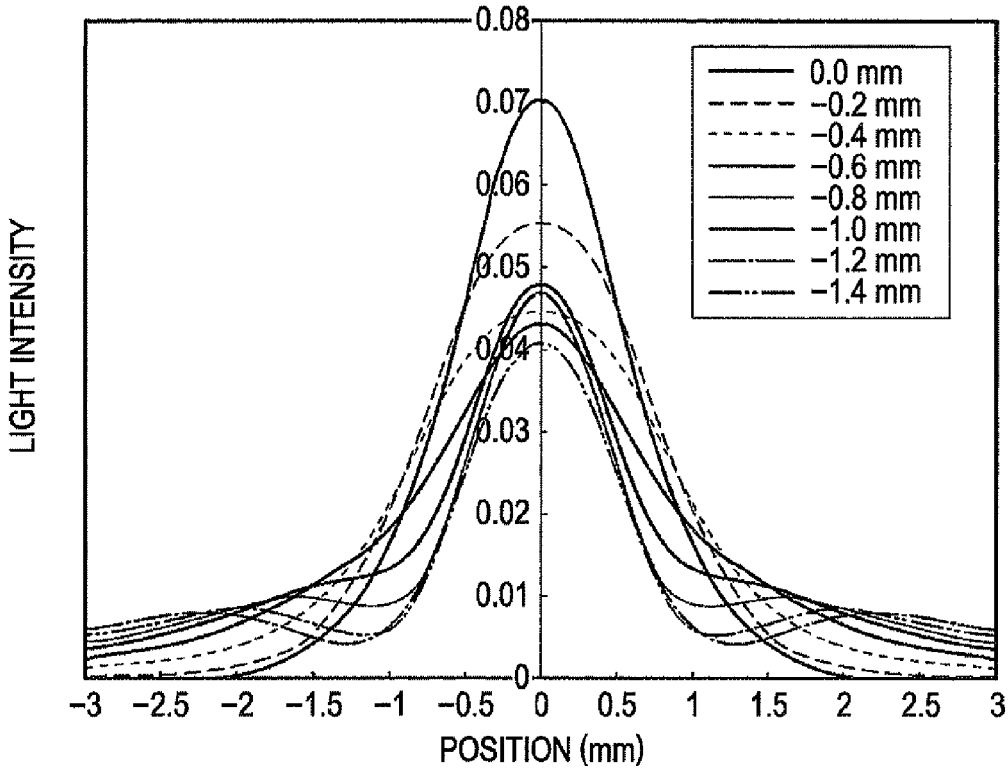
FIG. 15A is a graph of the relationship between the position on the continuous paper along the conveying direction and the light intensity at that position in the case where the continuous paper is displaced in a direction perpendicular to the conveying direction in the fixing apparatus according to the second exemplary embodiment of the present invention.
Figure 15B:
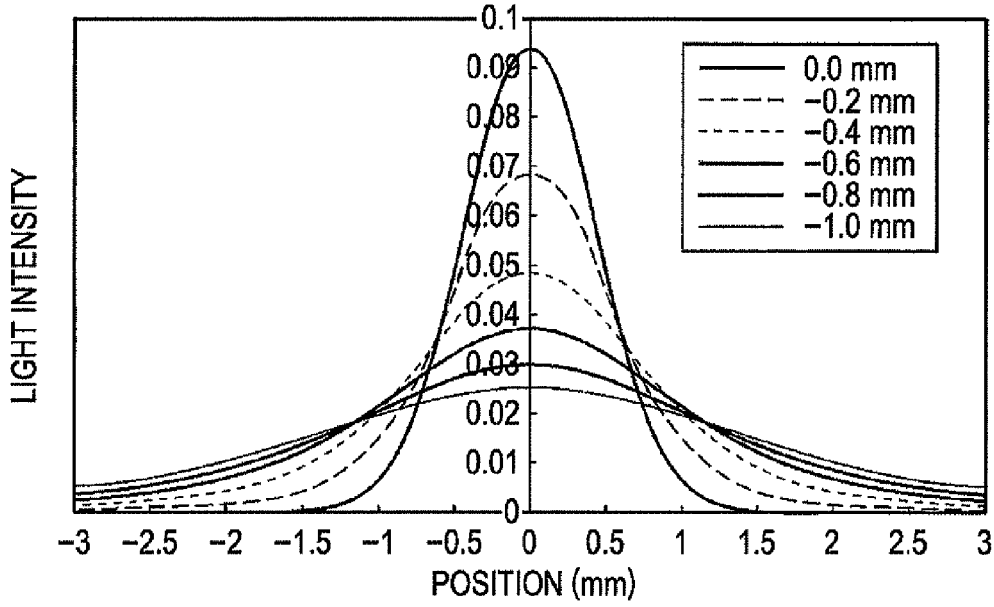
FIG. 15B is a graph of the relationship between the position on the continuous paper along the conveying direction and the light intensity at that position in the case where the continuous paper is displaced in a direction perpendicular to the conveying direction in the fixing apparatus according to the comparative example.

FIG. 15A illustrates the light intensity distribution in the fixing apparatus 60 according to the second exemplary embodiment. FIG. 15B illustrates the light intensity distribution in the fixing apparatus 200 according to the comparative example. With regard to the fixing apparatus 60, the light intensity distribution is measured for each of the cases where the continuous paper P is displaced from the reference position corresponding to the central axis O in design (X=0.0 mm) to X=−0.2 mm, −0.4 mm, −0.6 mm, −0.8 mm, −1.0 mm, −1.2 mm, and −1.4 mm. With regard to the fixing apparatus 200, the light intensity distribution is measured for each of the cases where the continuous paper P is displaced from the reference position (X=0.0 mm) to X=−0.2 mm, −0.4 mm, −0.6 mm, −0.8 mm, and −1.0 mm.

Referring to FIGS. 15A and 15B, the light intensity distribution in the fixing apparatus 60 according to the second exemplary embodiment and the light intensity distribution in the fixing apparatus 200 according to the comparative example will be compared with each other within a range in which the displacement of the continuous paper P is in the range of 0.0 mm to −1.0 mm. In the fixing apparatus 200 according to the comparative example, the light intensity is about 0.095 at the reference position, and is reduced to about 0.025 at −1.0 mm. Thus, the reduction percentage of the light intensity relative to the light intensity at the reference position is about 75%.

In the light intensity distribution in the fixing apparatus 60 according to the second exemplary embodiment, the light intensity is about 0.07 at the reference position, and is reduced to about 0.047 at −1.0 mm. Thus, the reduction percentage of the light intensity relative to the light intensity at the reference position is about 31%. Thus, variation in the light intensity, that is, variation in the density of irradiation energy applied to the toner on the continuous paper P and the heating energy applied to the toner, caused when the continuous paper P is displaced, is smaller in the fixing apparatus 60 according to the second exemplary embodiment than in the fixing apparatus 200 according to the comparative example.

Figure 16A:
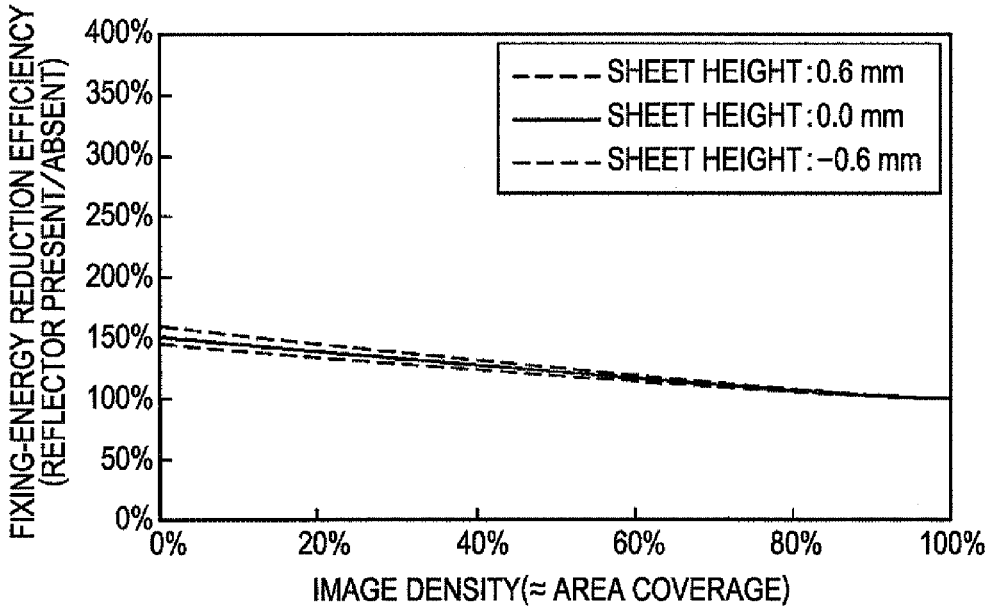
FIG. 16A is a graph of the relationship between the image density on the continuous paper and the fixing-energy reduction efficiency in the case where the continuous paper is displaced in a direction perpendicular to the conveying direction in the fixing apparatus according to the second exemplary embodiment of the present invention.
Figure 16B:
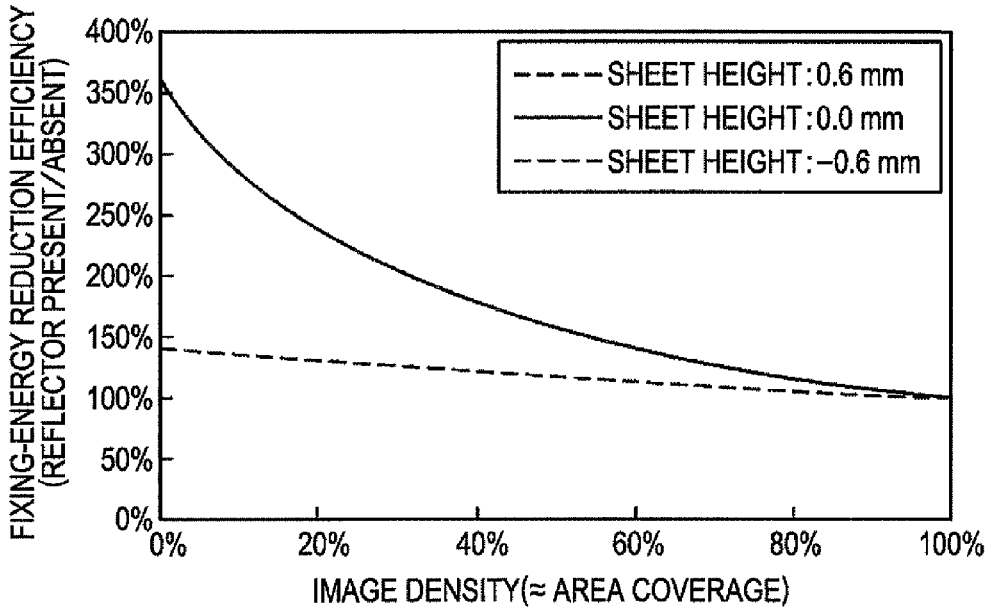
FIG. 16B is a graph of the relationship between the image density on the continuous paper and the fixing-energy reduction efficiency in the case where the continuous paper is displaced in a direction perpendicular to the conveying direction in the fixing apparatus according to the comparative example.

FIGS. 16A and 16B are graphs illustrating the relationship between the density of the toner image on the continuous paper P and the fixing-energy reduction efficiency in the cases where a sheet height at which the continuous paper P is positioned (position in the X direction) is set to 0.0 mm, +0.6 mm, and −0.6 mm in the fixing apparatus 60 according to the second exemplary embodiment and the fixing apparatus 200 according to the comparative example, respectively. In FIGS. 16A and 16B, the definitions of the fixing-energy reduction efficiency shown on the vertical axis and the image density shown on the horizontal axis are the same as those in FIGS. 11A and 11B.

As illustrated in FIG. 16B, in the fixing apparatus 200 according to the comparative example, the fixing-energy reduction efficiency is in the range of about 120% to 140% when the sheet height at which the continuous paper P is positioned is +0.6 mm or −0.6 mm. When the sheet height at which the continuous paper P is positioned is 0.0 mm, the fixing-energy reduction efficiency largely varies in the range of about 120% to 350%. This shows that the heating energy applied to the toner largely varies in accordance with a variation in the sheet height at which the continuous paper P is positioned.

As illustrated in FIG. 16A, in the fixing apparatus 60 according to the second exemplary embodiment, the fixing-energy reduction efficiency is in the range of about 120% to 150% in each of the cases where the sheet height at which the continuous paper P is positioned is +0.6 mm, 0.0 mm, and −0.6 mm. Thus, in the case where the fixing apparatus 60 according to the second exemplary embodiment is used, compared to the case in which the fixing apparatus 200 according to the comparative example is used, variation in the heating energy applied to the toner on the continuous paper P relative to the displacement of the continuous paper P is small. Therefore, stable toner-fixing performance and image quality may be provided.

In the fixing apparatus 60 according to the second exemplary embodiment, components of the reflected light LD reflected by the third, fourth, and fifth reflectors 62, 64, and 66 (see FIG. 12) intersect at different points in the directions of displacement of the continuous paper P. Therefore, the laser light is not collected at a certain position but is somewhat collected within a range in which the continuous paper P is displaced. Therefore, in the fixing apparatus 60, irrespective of whether the central axis O in design coincides with or differs from the fixing position PX (irrespective of whether or not the continuous paper P is displaced), sufficient heating energy may be applied to the toner on the continuous paper P and application of excessive heating energy may be prevented. As a result, degradation in the performance of fixing the toner on the continuous paper P and degradation in the image quality may be suppressed.

A fixing apparatus and an image forming apparatus according to a third exemplary embodiment of the present invention will now be described. Components similar to those in the first and second exemplary embodiments are denoted by the same reference numerals, and explanations thereof are thus omitted.

Figure 17:
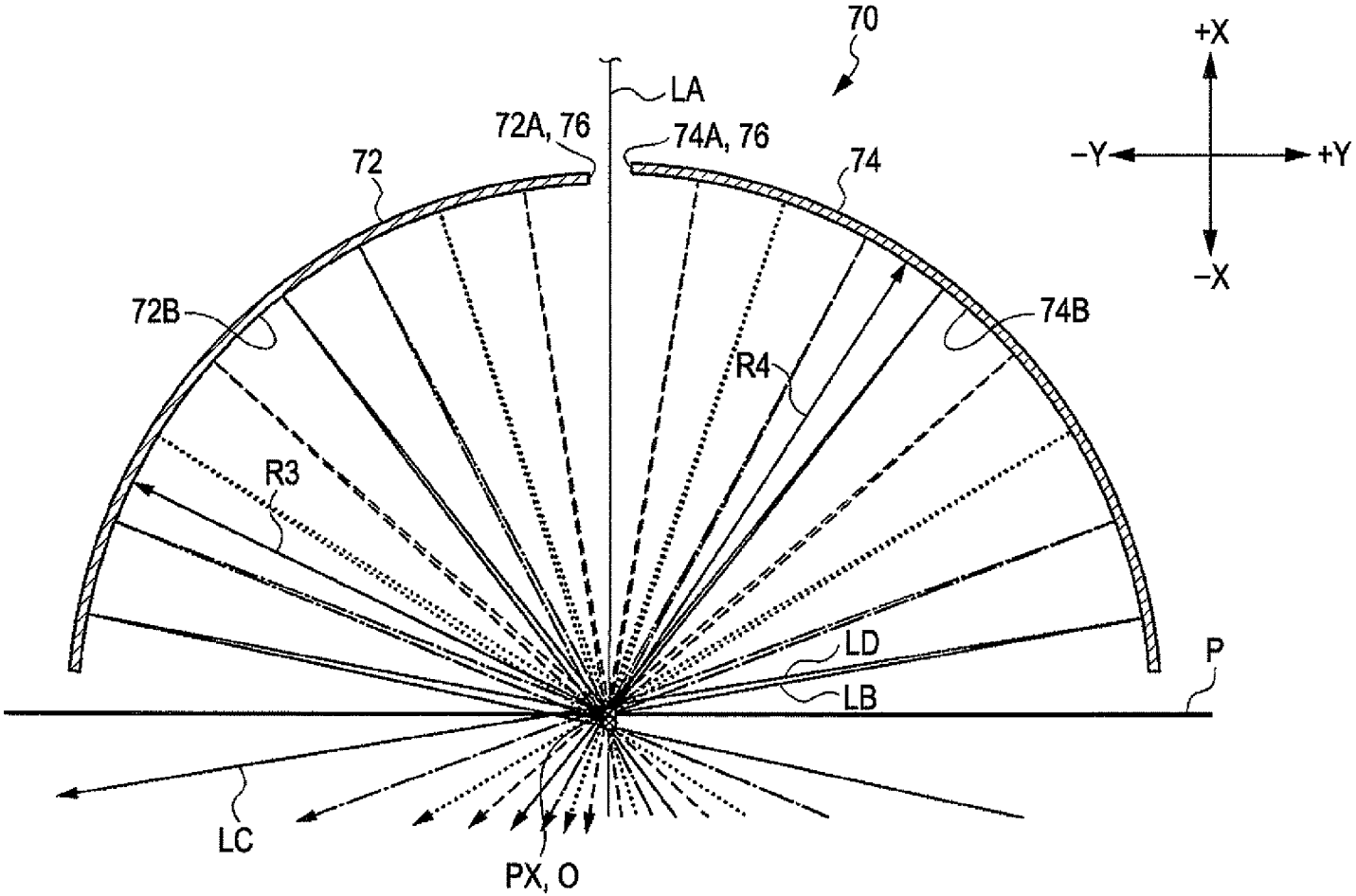
FIG. 17 is a schematic diagram illustrating the state in which laser light is reflected and collected by reflectors included in a fixing apparatus according to a third exemplary embodiment of the present invention.

FIG. 17 illustrates a fixing apparatus 70 according to the third exemplary embodiment. The fixing apparatus 70 includes the laser-light generators 52 (not shown), a sixth reflector 72, a seventh reflector 74, and a second reflector (not shown). The sixth and seventh reflectors 72 and 74 are an example of reflectors that reflect the scattered light LB, which is generated when a part of the laser light LA is reflected by the continuous paper P, toward the continuous paper P. The second reflector reflects the transmitted light LC, which is generated when a part of the laser light LA passes through the continuous paper P, toward the continuous paper P. Here, it is assumed that the sixth and seventh reflectors 72 and 74 have the same shape and dimension as those of the second reflector, and the second reflector is disposed symmetrically to the sixth and seventh reflectors 72 and 74 with respect to the central axis O in design. Therefore, explanations regarding the reflection of laser light by the second reflector will be omitted, and only the sixth and seventh reflectors 72 and 74 will be described.

The sixth reflector 72 is formed of a metal mirror having an arc shape with a radius of R3 in cross section in the X-Y plane. The length of the arc is about one-fourth of the circumference of a circle (central angle is about 90°). The sixth reflector 72 is shaped such that the longitudinal direction thereof coincides with the Z direction (direction perpendicular to FIG. 17), and is disposed such a sixth reflective surface 72B, which is a concave surface, faces an area of the image surface of the continuous paper P on the −Y side of the fixing position PX.

The central axis in design at the center of a circle on which the sixth reflector 72 is positioned in the X-Y plane (point F5 in FIG. 18) is on the −X side of the continuous paper P in the state in which the continuous paper P is stationary without being bent or displaced in the X direction. The sixth reflective surface 72B is disposed so as to cover the area on the −Y side of the fixing position PX and to cover the image area of the continuous paper P over the entire width thereof in the Z direction. Accordingly, the sixth reflector 72 collects a large amount of the scattered light LB reflected by the continuous paper P at a position on the −X side of the fixing position PX.

The seventh reflector 74 is formed of a metal mirror having an arc shape with a radius of R4 (>R3) in cross section in the X-Y plane. The length of the arc is about one-fourth of the circumference of a circle (central angle is about 90°). The seventh reflector 74 is shaped such that the longitudinal direction thereof coincides with the Z direction (direction perpendicular to FIG. 12), and is disposed such a seventh reflective surface 74B, which is a concave surface, faces an area of the image surface of the continuous paper P on the +Y side of the fixing position PX.

The central axis in design at the center of a circle on which the seventh reflector 74 is positioned in the X-Y plane (point F6 in FIG. 18) is at the fixing position PX of the continuous paper P in the state in which the continuous paper P is stationary without being bent or displaced in the X direction. The seventh reflective surface 74B is disposed so as to cover the area on the +Y side of the fixing position PX and to cover the image area of the continuous paper P over the entire width thereof in the Z direction. Accordingly, the seventh reflector 74 collects a large amount of the scattered light LB reflected by the continuous paper P at the fixing position PX or at a position on the +X side of the fixing position PX.

An upper right edge portion 72A of the sixth reflector 72 and an upper left edge portion 74A of the seventh reflector 74 are spaced from each other so that a light entrance 76 that extends in the Z direction is formed therebetween. Accordingly, the laser light LA emitted from the laser-light generators 52 (see FIG. 2) toward the continuous paper P passes through the light entrance 76 and is incident on the image surface of the continuous paper P.

Figure 18:
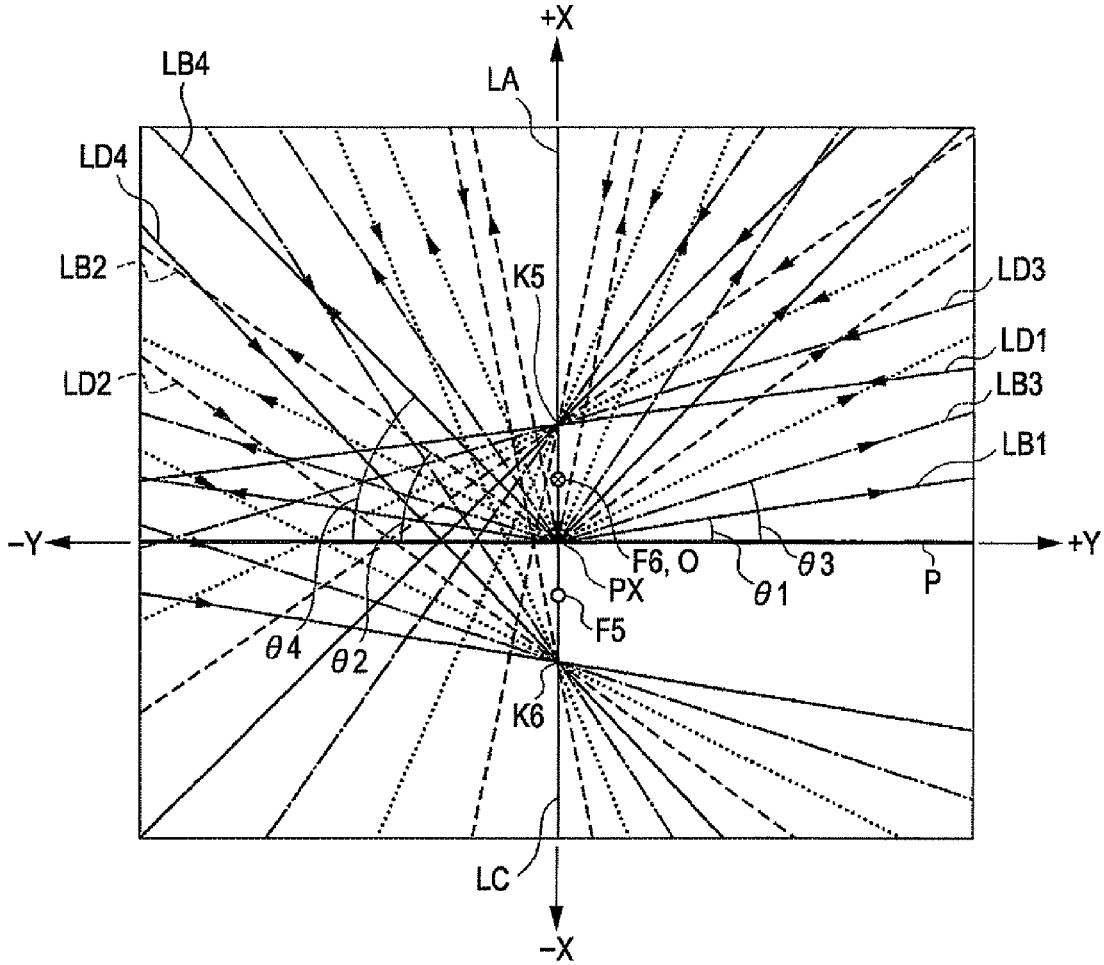
FIG. 18 is a schematic diagram illustrating the state in which the laser light is collected on continuous paper in the fixing apparatus according to the third exemplary embodiment of the present invention.

Referring to FIG. 18, in the laser light LA emitted by the laser-light generators 52 (see FIG. 2) in the fixing apparatus 70, a first angular component, a second angular component, a third angular component, and a fourth angular component of the laser light reflected (scattered) by the continuous paper P at the fixing position PX are defined as LB1, LB2, LB3, and LB4, respectively. For example, the first angular component LB1 is a component of the laser light that is reflected in a direction at an angle θ1 with respect to the +Y direction, and the second angular component LB2 is a component of the laser light that is reflected in a direction at an angle θ2 (>θ1) with respect to the −Y direction. The third angular component LB3 is a component of the laser light that is reflected in a direction at an angle θ(θ1<θ3<θ2) with respect to the +Y direction, and the fourth angular component LB4 is a component of the laser light that is reflected in a direction at an angle θ(>θ1, θ2, θ3) with respect to the −Y direction. Although there are infinite numbers of components in the laser light in practice, the first angular component LB1, the second angular component LB2, the third angular component LB3, and the fourth angular component LB4 will be considered herein.

In addition, in the laser light reflected by the sixth reflector 72, a component obtained as a result of reflection of the second angular component LB2 by the sixth reflective surface 72B is defined as a second angular component LD2, and a component obtained as a result of reflection of the fourth angular component LB4 by the sixth reflective surface 72B is defined as a fourth angular component LD4. In addition, in the laser light reflected by the seventh reflector 74, a component obtained as a result of reflection of the first angular component LB1 by the seventh reflective surface 74B is defined as a first angular component LD1, and a component obtained as a result of reflection of the third angular component LB3 by the seventh reflective surface 74B is defined as a third angular component LD3.

The operation of the third exemplary embodiment will now be described.

As illustrated in FIG. 17, in the fixing apparatus 70, when the laser light LA is emitted from the laser-light generators 52 (see FIG. 3) toward the continuous paper P, a part of the laser light LA is reflected at the fixing position PX as the scattered light LB, and another part of the laser light LA passes through the continuous paper P as the transmitted light LC. The scattered light LB is reflected by the sixth and seventh reflective surfaces 72B and 74B. If the fixing position PX is at the central axis O in design, the reflected light LD reflected by the sixth reflective surface 72B travels toward positions different from the fixing position PX along reflective angle directions corresponding to the incident angles of the scattered light LB. Similarly, the reflected light LD reflected by the seventh reflective surface 74B travels toward the fixing position PX along reflective angle directions corresponding to the incident angles of the scattered light LB.

Here, in the fixing apparatus 70 (see FIG. 17), it is assumed that the tension applied to the continuous paper P during conveyance is changed, for example, and the continuous paper P is displaced from the point O in the −X direction owing to bending of the continuous paper P or the like. In this case, as illustrated in FIG. 18, the position of the central axis O and the fixing position PX of the laser light LA are shifted from each other. In the X-Y plane, a first intersection point K5 at which the first angular component LD1 and the third angular component LD5 of the laser light reflected by the seventh reflector 74 intersect and a second intersection point K6 at which the second angular component LD2 and the fourth angular component LD4 of the laser light reflected by the sixth reflector 72 intersect are at different positions in the X direction. In other words, components of the laser light that has been reflected at the fixing position PX and then reflected by the sixth and seventh reflectors 72 and 74 travel straight through points at different positions in the X direction in the X-Y plane.

Figure 19A:
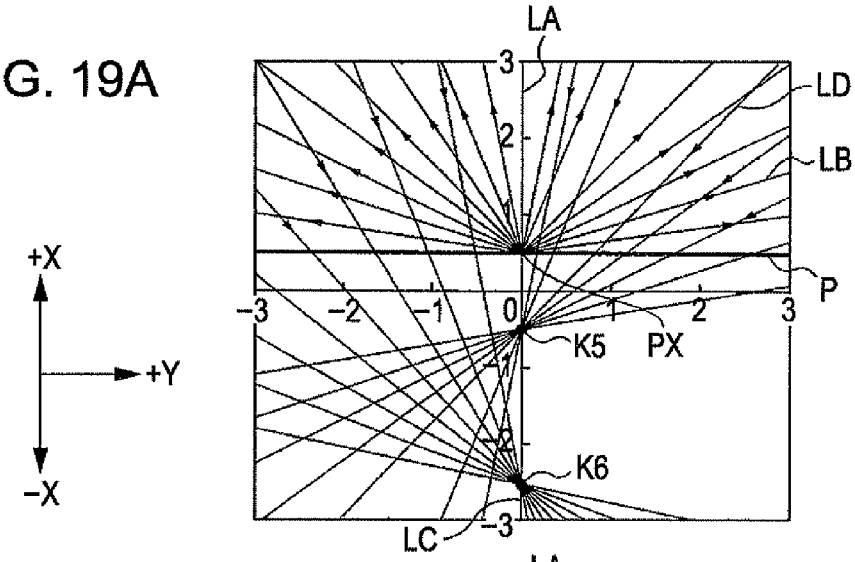
FIGS. 19A, 19B, and 19C are schematic diagrams illustrating the state in which the laser light is reflected by the continuous paper and the laser light reflected by the reflectors is collected on the continuous paper in the case where the continuous paper is displaced in a direction perpendicular to a conveying direction in the fixing apparatus according to the third exemplary embodiment of the present invention.
Figure 19B:
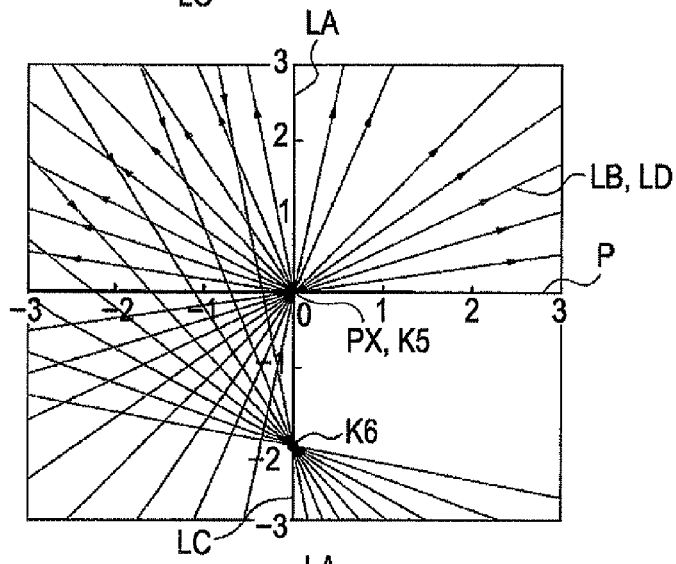

Referring to FIG. 198, in the fixing apparatus 70, when the continuous paper P is at the central axis O in design (origin (0,0) in FIG. 19B), a part of the laser light LA emitted toward the fixing position PX is reflected by the continuous paper P as the scattered light LB, and the scattered light LB is then reflected by the sixth and seventh reflectors 72 and 74 as the reflected light LD. In the X-Y plane, the reflected light LD from the sixth reflector 72 is collected at the second intersection point K6 at a position different from the fixing position PX, and the reflected light LD from the seventh reflector 74 is collected at the first intersection point K5 at the same position as the fixing position PX.

Referring to FIG. 19A, when the position of the continuous paper P is displaced from the central axis O in design in the +X direction, that is, when the fixing position PX is shifted in the +X direction, the second intersection point K6 of the reflected light LD reflected by sixth reflector 72 and the first intersection point K5 of the reflected light LD reflected by the seventh reflector 74 are at different positions that are shifted from the fixing position PX in the −X direction in the X-Y plane.

Figure 19C:
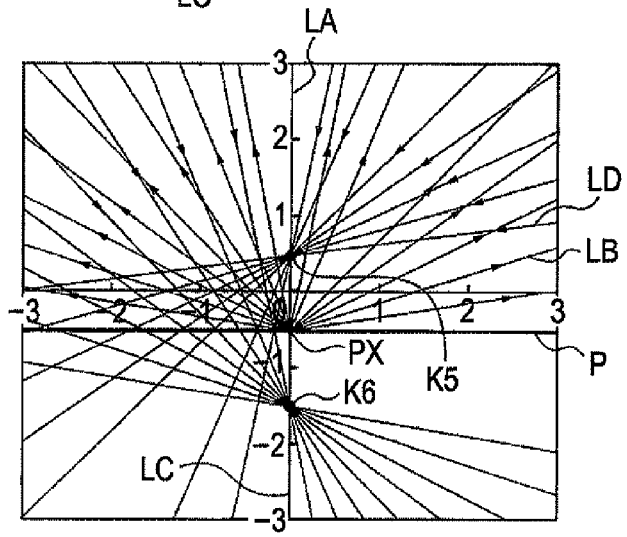

In addition, referring to FIG. 19C, when the position of the continuous paper P is displaced from the central axis O in design in the −X direction, that is, when the fixing position PX is shifted in the −X direction, the second intersection point K6 of the reflected light LD reflected by sixth reflector 72 and the first intersection point K5 of the reflected light LD reflected by the seventh reflector 74 are at different positions that are shifted from the fixing position PX in the +X direction in the X-Y plane. Thus, in the fixing apparatus 70 according to the third exemplary embodiment, the first intersection point K5 at which the reflected light from the seventh reflector 74 is collected and the position of the second intersection point K6 at which the reflected light LD from the sixth reflector 72 is collected are at different positions in the direction of displacement of the continuous paper P in the X-Y plane.

The difference between the state in which the reflected light LD is collected in the fixing apparatus 70 according to the third exemplary embodiment and the state in which the reflected light LD is collected in the fixing apparatus 200 (see FIG. 7) according to the comparative example will now be discussed. In the fixing apparatus 200 according to the comparative example, the reflected light LD is collected at a single point in the X-Y plane. In contrast, in the fixing apparatus 70 according to the third exemplary embodiment, the reflected light LD is collected at points in the direction of displacement of the continuous paper P in the X-Y plane. In other words, in the fixing apparatus 200 according to the comparative example, the collection area of the reflected light LD is a small area located at substantially a single point in the X-Y plane. In the fixing apparatus 70 according to the third exemplary embodiment, the collection area of the reflected light LD expands in the X direction and is broader than that in the fixing apparatus 200 according to the comparative example. Thus, the state in which the reflected light LD is collected differs between the fixing apparatus 200 according to the comparative example and the fixing apparatus 70 according to the third exemplary embodiment.

It is clear from the above description that the focal depth of the reflected light LD in the fixing apparatus 70 according to the third exemplary embodiment is broader than that in the fixing apparatus 200 according to the comparative example when the continuous paper P is displaced. Therefore, in the fixing apparatus 70 according to the third exemplary embodiment, optical energy higher than or equal to a certain level may be applied to the toner even when the continuous paper P is displaced. Accordingly, the relationship between the position on the continuous paper P along the Y direction and the light intensity at that position in the case where the continuous paper P is displaced in the X direction is considered for each of the fixing apparatus 70 according to the third exemplary embodiment and the fixing apparatus 200 according to the comparative example.

Figure 20A:
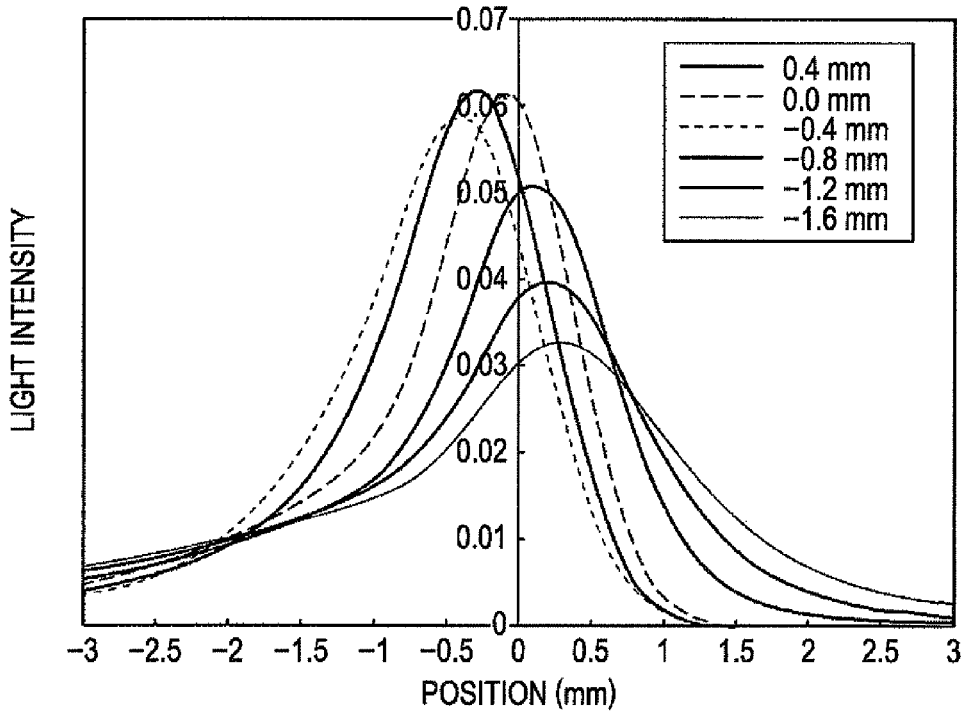
FIG. 20A is a graph of the relationship between the position on the continuous paper along the conveying direction and the light intensity at that position in the case where the continuous paper is displaced in a direction perpendicular to the conveying direction in the fixing apparatus according to the third exemplary embodiment of the present invention.
Figure 20B:
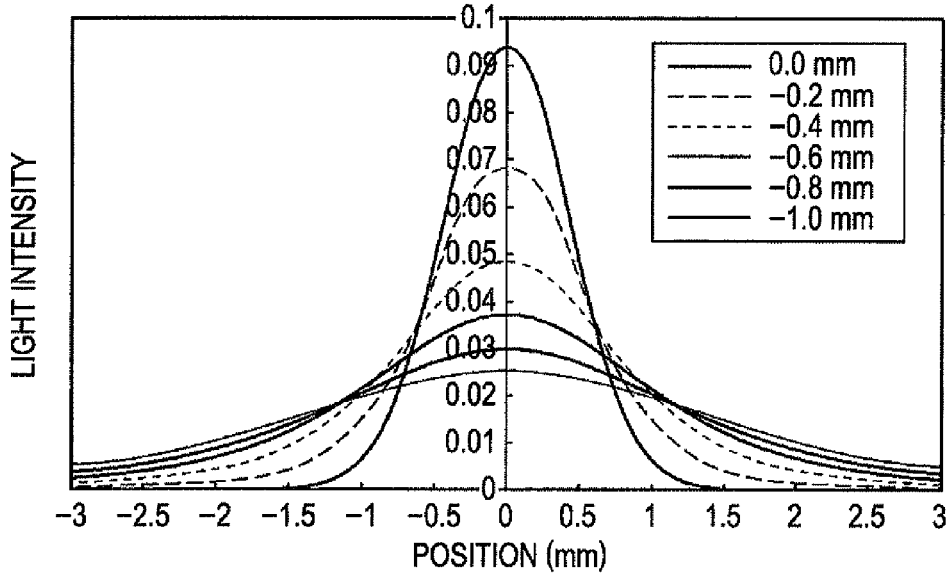
FIG. 20B is a graph of the relationship between the position on the continuous paper along the conveying direction and the light intensity at that position in the case where the continuous paper is displaced in a direction perpendicular to the conveying direction in the fixing apparatus according to the comparative example.

FIG. 20A illustrates the light intensity distribution in the fixing apparatus 70 according to the third exemplary embodiment. FIG. 20B illustrates the light intensity distribution in the fixing apparatus 200 according to the comparative example. With regard to the fixing apparatus 70, the light intensity distribution is measured for each of the cases where the continuous paper P is displaced from the reference position corresponding to the central axis O in design (X=0.0 mm) to X=+0.4 mm, −0.4 mm, −0.8 mm, −1.2 mm, and −1.6 mm. With regard to the fixing apparatus 200, the light intensity distribution is measured for each of the cases where the continuous paper P is displaced from the reference position (X=0.0 mm) to X=−0.2 mm, −0.4 mm, −0.6 mm, −0.8 mm, and −1.0 mm.

Referring to FIGS. 20A and 20B, the light intensity distribution in the fixing apparatus 70 according to the third exemplary embodiment and the light intensity distribution in the fixing apparatus 200 according to the comparative example will be compared with each other within a range in which the displacement of the continuous paper P is in the range of 0.0 mm to −0.8 mm. In the fixing apparatus 200 according to the comparative example, the light intensity is about 0.095 at the reference position, and is reduced to about 0.03 at −0.8 mm. Thus, the reduction percentage of the light intensity relative to the light intensity at the reference position is about 68%.

In the light intensity distribution in the fixing apparatus 70 according to the third exemplary embodiment, the light intensity is about 0.06 at the reference position, and is reduced to about 0.052 at −0.8 mm. Thus, the reduction percentage of the light intensity relative to the light intensity at the reference position is about 13%. Thus, variation in the light intensity, that is, variation in the density of irradiation energy applied to the toner on the continuous paper P and the heating energy applied to the toner, caused when the continuous paper P is displaced, is smaller in the fixing apparatus 70 according to the third exemplary embodiment than in the fixing apparatus 200 according to the comparative example.

Figure 21A:
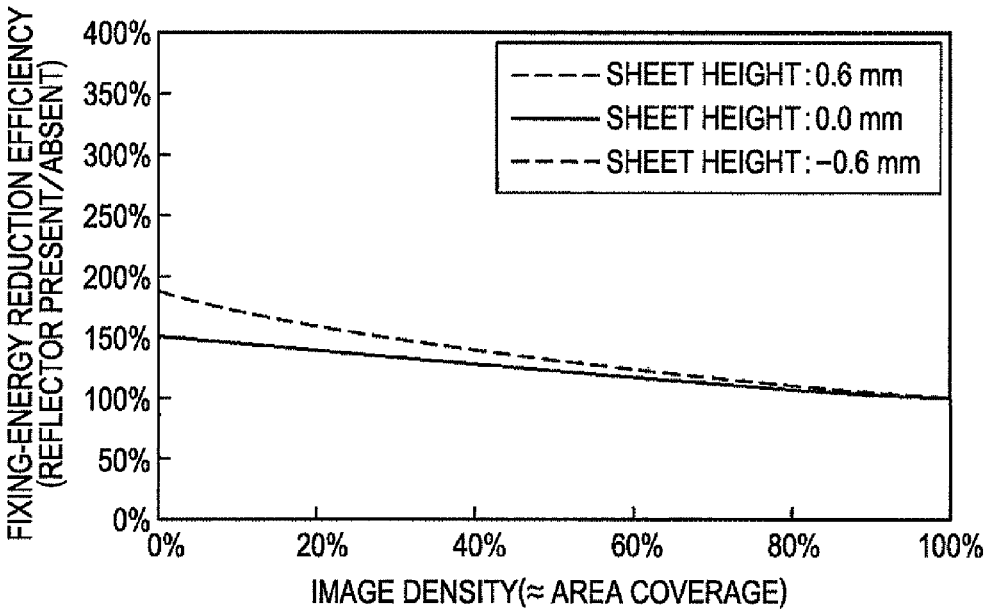
FIG. 21A is a graph of the relationship between the image density on the continuous paper and the fixing-energy reduction efficiency in the case where the continuous paper is displaced in a direction perpendicular to the conveying direction in the fixing apparatus according to the third exemplary embodiment of the present invention.
Figure 21B:
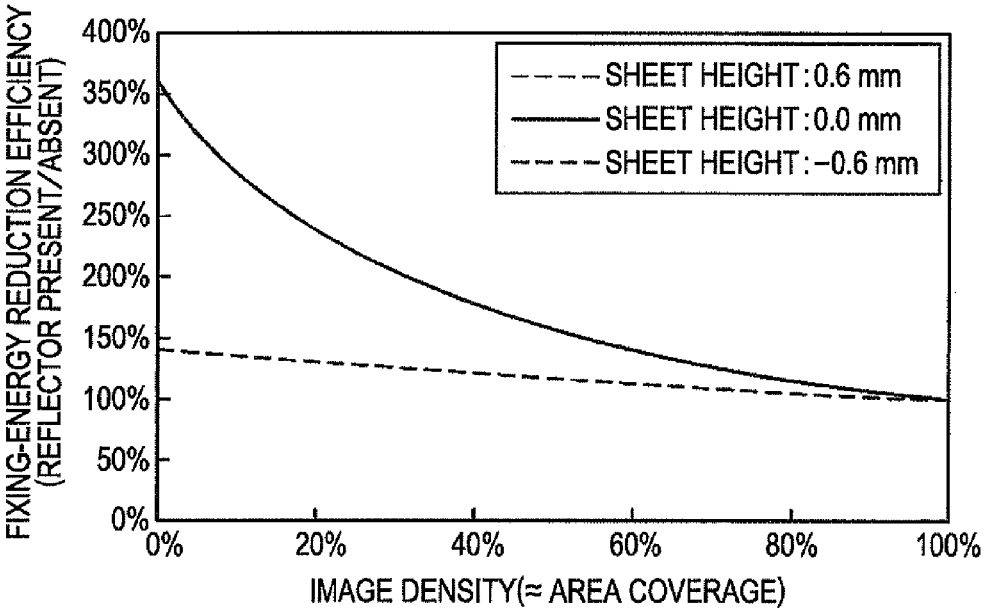
FIG. 21B is a graph of the relationship between the image density on the continuous paper and the fixing-energy reduction efficiency in the case where the continuous paper is displaced in a direction perpendicular to the conveying direction in the fixing apparatus according to the comparative example.

FIGS. 21A and 21B are graphs illustrating the relationship between the density of the toner image on the continuous paper P and the fixing-energy reduction efficiency in the cases where a sheet height at which the continuous paper P is positioned (position in the X direction) is set to 0.0 mm, +0.6 mm, and −0.6 mm in the fixing apparatus 70 according to the third exemplary embodiment and the fixing apparatus 200 according to the comparative example, respectively. In FIGS. 21A and 21B, the definitions of the fixing-energy reduction efficiency shown on the vertical axis and the image density shown on the horizontal axis are the same as those in FIGS. 11A and 11B.

As illustrated in FIG. 21B, in the fixing apparatus 200 according to the comparative example, the fixing-energy reduction efficiency is in the range of about 120% to 140% when the sheet height at which the continuous paper P is positioned is +0.6 mm or −0.6 mm. When the sheet height at which the continuous paper P is positioned is 0.0 mm, the fixing-energy reduction efficiency largely varies in the range of about 120% to 350%. This shows that the heating energy applied to the toner largely varies in accordance with a variation in the sheet height at which the continuous paper P is positioned.

As illustrated in FIG. 21A, in the fixing apparatus 70 according to the third exemplary embodiment, the fixing-energy reduction efficiency is in the range of about 100% to 150% when the sheet height at which the continuous paper P is positioned is +0.6 mm or −0.6 mm. When the sheet height at which the continuous paper P is positioned is 0.0 mm, the fixing-energy reduction efficiency varies in the range of about 100% to 190%. Thus, in the case where the fixing apparatus 70 according to the third exemplary embodiment is used, compared to the case in which the fixing apparatus 200 according to the comparative example is used, variation in the heating energy applied to the toner on the continuous paper P relative to the displacement of the continuous paper P is small. Therefore, stable toner-fixing performance and image quality may be provided.

In the fixing apparatus 70 according to the third exemplary embodiment, components of the reflected light LD reflected by the sixth and seventh reflectors 72 and 74 (see FIG. 17), which have cross sections that are asymmetric to each other in the X-Y plane, intersect at different points in the direction of displacement of the continuous paper P. Therefore, the laser light is not collected at a certain position but is somewhat collected within a range in which the continuous paper P is displaced. Therefore, in the fixing apparatus 70, irrespective of whether the central axis O in design coincides with or differs from the fixing position PX (irrespective of whether or not the continuous paper P is displaced), sufficient heating energy may be applied to the toner on the continuous paper P and application of excessive heating energy may be prevented. As a result, degradation in the performance of fixing the toner on the continuous paper P and degradation in the image quality may be suppressed.

Figure 22:
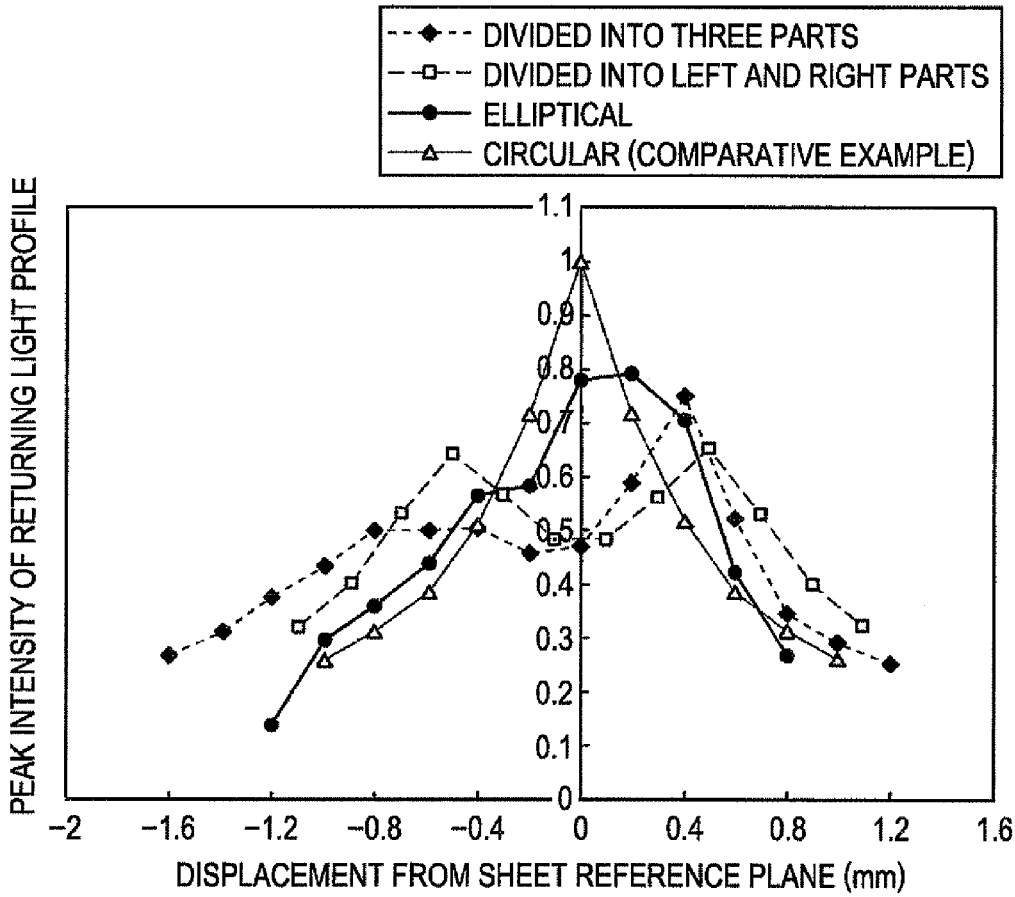
FIG. 22 is a graph of the relationship between the displacement (amount of shift) of the continuous paper from a reference plane and the peak intensity of the returning light profile in the fixing apparatuses according to the first, second, and third exemplary embodiments of the present invention and the fixing apparatus according to the comparative example.

FIG. 22 shows the relationship between the displacement (amount of shift) of the continuous paper P from the reference plane in the X direction and the peak intensity of the returning light profile at the fixing position PX in the fixing apparatuses 50, 60, and 70 according to the first, second, and third exemplary embodiments and the fixing apparatus 200 according to the comparative example. As is clear from FIG. 22, when the position of the continuous paper P is displaced by ±0.5 mm, the peak intensity largely varies in the fixing apparatus 200 according to the comparative example (circular). In contrast, in each of the fixing apparatus 50 according to the first exemplary embodiment (elliptical), the fixing apparatus 60 according to the second exemplary embodiment (divided into three parts), and the fixing apparatus 70 according to the third exemplary embodiment (divided into left and right parts), variation in the peak intensity is smaller than that in the fixing apparatus 200 according to the comparative example. Therefore, the fixing apparatuses 50, 60, and 70 according to the exemplary embodiments may increase the stability of the fixing performance and the image quality compared to that in the fixing apparatus 200 according to the comparative example.

The present invention is not limited to the above-described exemplary embodiments.

For example, instead of using the continuous paper P as the recording medium, cut sheets based on a common standard may be conveyed one by one in the image forming apparatus 10. In addition, the laser light may be collected at the fixing position PX without using the second reflector at the back side of the continuous paper P. In addition, dielectric mirrors in which the reflectance is increased by staking a dielectric having a high refractive index and a dielectric having a low refractive index may be used in place of the metal mirrors used as the reflectors.

In addition, to prevent the reflective surfaces from being stained, each reflector may be provided with a glass plate disposed at the side opposed to the continuous paper P to cover the reflective surface. In addition, the second reflector may have a shape that is different from the shape of any one of the first reflector 54 to the seventh reflector 74 that are opposed to the second reflector with the continuous paper P disposed therebetween.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A fixing apparatus, comprising:

a light irradiation unit that emits laser light to irradiate a recording medium conveyed in a conveying direction, the laser light being emitted along a first direction that is substantially perpendicular to the conveying direction; and a reflector that reflects a first angular component, a second angular component, a third angular component, and a fourth angular component of a part of the laser light emitted by the light irradiation unit, the part of the laser light being reflected at an irradiation position at which the recording medium is irradiated with the laser light by the light irradiation unit, the second angular component being different from the first angular component, the third angular component being different from or the same as the first angular component, the fourth angular component being different from the first, second, and third angular components, the reflector reflecting the first, second, third, and fourth angular components such that a first intersection point between the first and third angular components after the reflection as seen in a second direction that is substantially perpendicular to the conveying direction and the first direction and a second intersection point between the second and fourth angular components after the reflection as seen in the second direction are at different positions in a direction of displacement of the recording medium, the direction of displacement crossing the conveying direction, wherein a developing agent on the recording medium is melted by energy of the laser light.

2. The fixing apparatus according to claim 1, wherein the reflector includes a plurality of arc members, each arc member having an arc-shaped reflective surface when viewed in the second direction, the arc members being disposed at positions shifted from each other in the direction of displacement of the recording medium.

3. An image forming apparatus comprising:

an image forming member that forms an image on a recording medium with a developing agent; and the fixing apparatus according to claim 1, the fixing apparatus fixing the image formed by the image forming member on the recording medium by melting the developing agent.

4. An image forming apparatus comprising:

an image forming member that forms an image on a recording medium with a developing agent; and the fixing apparatus according to claim 2, the fixing apparatus fixing the image formed by the image forming member on the recording medium by melting the developing agent.

* * * * *